United States Patent [19]

Hannon

[11] Patent Number: 4,805,381

[45] Date of Patent: Feb. 21, 1989

[54] NEWSPAPER BAGGING METHOD AND APPARATUS

[75] Inventor: Charles N. Hannon, Olathe, Kans.

[73] Assignee: Stepper, Inc., Olathe, Kans.

[21] Appl. No.: 22,436

[22] Filed: Mar. 6, 1987

[51] Int. Cl.[4] ..... B65B 43/34; B65B 43/36; B65B 43/20

[52] U.S. Cl. ..... 53/459; 53/469; 53/572

[58] Field of Search ..... 53/459, 469, 480, 571, 53/572, 379, 261

[56] References Cited

U.S. PATENT DOCUMENTS

| | | | |
|---|---|---|---|
| 3,165,870 | 1/1965 | Saumsiegle et al. | 53/572 |
| 3,330,093 | 7/1967 | Schorer | 53/572 |
| 3,367,087 | 2/1968 | Jarund | 53/571 |
| 3,440,801 | 4/1969 | Prince et al. | 53/572 |
| 3,491,514 | 1/1970 | Burford | 53/572 |
| 3,590,553 | 7/1971 | Formo | 53/572 X |
| 3,838,805 | 10/1974 | Amberg | 53/329 X |
| 4,018,031 | 4/1977 | Smaw | 53/379 X |
| 4,047,362 | 9/1977 | Lister et al. | 53/572 |
| 4,073,122 | 2/1978 | Areson | 53/572 X |
| 4,079,572 | 3/1978 | Vande Castle | 53/379 X |
| 4,557,472 | 12/1985 | Hannon . | |
| 4,702,467 | 10/1987 | Hannon . | |

*Primary Examiner*—Horace M. Culver

*Attorney, Agent, or Firm*—Hovey, Williams, Timmons & Collins

[57] ABSTRACT

Multiple section, quarter-folded bulky newspapers in flat form are inserted into and sealed within transparent polyethylene bags without first rolling or folding the newspapers into smaller bundles so as to present generally flat, weather-resistant, tamper-deterring packages which may be readily stacked, shipped and otherwise handled. The newspapers are delivered seriatim to an inserting station at which the leading newspaper is fed into the open mouth of the topmost bag in a wicketed stack of the bags, whereupon the bagged newspaper package tears free from the wicket and advances downstream to a heat sealing mechanism. Just prior to passing beneath the heat sealer, a marginal, entry end portion of the bag is folded back on top of the package so that, as the package passes under the sealer, the marginal portion is fused against the top wall of the bag while the encapsulated newspaper serves as a heat sink, thereby securely closing the bag mouth and completing the sealed package. The newspaper contents of the package may be thereafter readily removed by tearing open the bag and discarding the same.

22 Claims, 10 Drawing Sheets

NEWSPAPER BAGGING METHOD AND APPARATUS

TECHNICAL FIELD

This invention relates to the handling and collating of bulky, multiple section newspapers and, more particularly, to the safe and secure packaging of such newspapers into individual, transparent, protective bags.

BACKGROUND ART

Newspapers are inherently difficult to collate, feed and handle because of their bulky yet flimsy natures. Big city newspapers in particular have presented formidible obstacles because the shear size and mass of their many sections make the newspapers almost impossible to fold, tie or wrap. Thus, many such newspapers are simply assembled and sold in flat, half-folded form, each newspaper comprising two or more short stacks of nested, half-folded sections. However, with this arrangement it is difficult to keep all parts of the newspaper assembled together, and such a loose product is impossible to throw from moving vehicles during residential delivery.

Furthermore, the trend in recent years has been for advertisers to place a growing number of advertising media or loose "inserts" into such newspapers in an effort to reach the consuming public as an alternative to direct mail and other methods. These inserts pose a particular problem in that they are typically coated with a relatively slick substance that encourages them to slip out of the newspapers and become lost during handling. Moreover, they are of considerable value monetarily, and thus present an attractive target for unscrupulous individuals who might pilfer the inserts without purchasing a complete newspaper.

Consequently, the need has been increasingly felt for a system of bagging such newspapers in a flat condition in protective, transparent bags or wrappers to overcome the numerous problems brought on by the growth and changes in the newspaper industry. However, to the best of my knowledge, no satisfactory, high speed, commercially acceptble system of this type has heretofore been available, notwithstanding the pressing need for such a system in recent years.

SUMMARY OF THE INVENTION

Accordingly, one important object of the present invention is to provide a bagging system which is capable of reliably placing assembled, half-folded newspapers in flat form in sealed plastic bags and doing so at a commercially acceptable high rate of speed with only a minimum of operator attention.

Pursuant to the foregoing, the present invention contemplates a system in which the individual, assembled newspapers are presented seriatim to an inserting station at which a series of transparent thermoplastic bags await their arrival, the uppermost bag in the series being held open by positive pressure air streams and mechanical retainers to facilitate smooth entry of the leading newspaper into the bag. As the leading newspaper becomes fully received within the bag and the resulting package is fed away from the station, the bag tears free from a wicket holding the supply of bags in place at the station. Thereafter, the package passes through the sealing section of the system wherein the marginal entry end portion of the bag is folded over on top of the package before being passed beneath a heat sealer which securely fuses the marginal portion to the top wall of the bag. By applying the heat seal at a portion of the bag containing the newspaper therebeneath, the newspaper itself can serve as a heat sink to allow higher temperatures to be utilized by the sealer for more rapid sealing. Special modules containing individual supplies of the bags are carried on an indexing mechanism which successively presents the modules to the station and retains them at that location until the bag supply has been depleted, whereupon the next module is automatically indexed into proper position. Depleted modules may be easily uncoupled from the indexing mechanism and manually replenished with a fresh supply of the bags.

BRIEF DESCRIPTION OF THE DRAWINGS

FIG. 17 is an enlarged, fragmentary, longitudinal, cross-sectional view of the sealed newspaper package of FIG. 16 illustrating details of construction;

DETAILED DESCRIPTION

Figure 1:
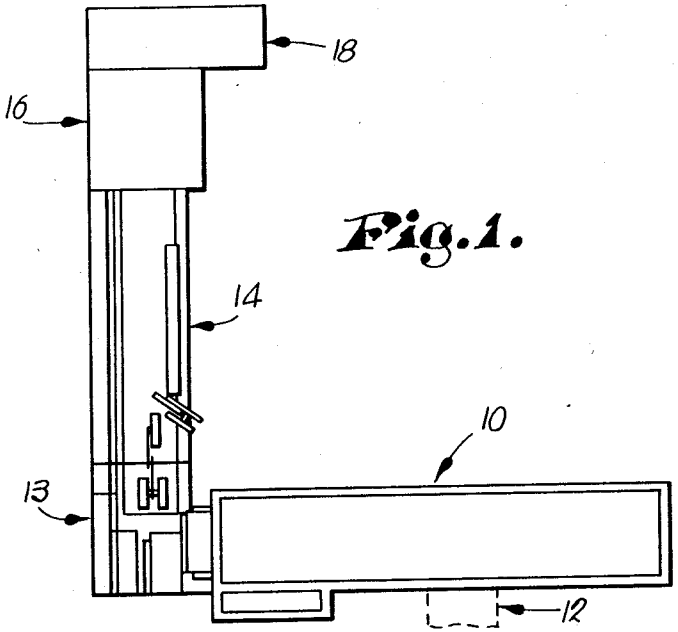
FIG. 1 is a top plan view of a system for bagging newspapers in accordance with the principles of the present invention and capable of carrying out my novel method.

FIG. 1 illustrates schematically the major components that comprise the newspaper bagging system according to the present invention. In this respect it will be noted that the bag inserting machine 10 of the system receives assembled newspapers at a regular, metered rate of feed from a supply conveyor 12. After being inserted into bags by the machine 10, the packages are successively discharged from the left end of the machine 10 into a unit 13 that changes their direction of travel by 90° and feeds the packages into the heat sealing machine 14, where they are tightly sealed into a finished and completed product. From the sealer 14, the finished packages are discharged onto a slightly upwardly inclined, elevating conveyor 16 which feeds the packages into a stacker-counter 18. Within the stacker-counter 18, the packages are accumulated until a predetermined number thereof have collected whereupon they are discharged onto a collecting platform or the like (not shown) for manual handling. By using the stacker-counter 18 to accumulate packages in pre-counted bundles for strapping, workers loading the bundles onto trucks and the like are able to keep pace with the high speed throughput of the system.

The Bag Inserting Machine

The inserting machine 10 includes a bag inserting station broadly denoted by the numeral 20 at which actual insertion of assembled newspapers into bags takes place. Immediately to the right of inserting station 20 (viewing FIGS. 2–5) an upstream therefrom with respect to the direction of travel of the newspapers through the machine 10 is disposed a received 22 for receiving assembled newspapers from the supply conveyor 12. Preferably, the newspapers issue from supply conveyor 12 wih their half-fold lines leading so that, as the newspapers subsequently move leftwardly through the machine 10 (viewing FIGS. 2–5), the longer, longitudinal dimension of each newspaper coincides with the direction of travel thereof.

Figure 18:
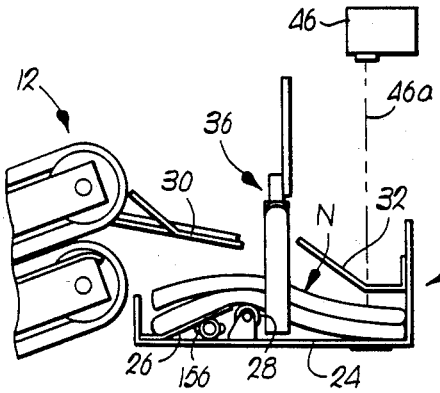
FIG. 18 is a fragmentary, schematic, transverse elevational view of the bag inserting machine illustrating the condition of a multiple section newspaper when the newspaper is first received from supply apparatus which feeds the machine.

The receiver 22 is stationarily disposed within the frame of the machine and includes a floor 24 of generally transversely U-shaped configuration, as illustrated, for example, in FIG. 18. The receiver 2 is only slightly wider than the newspapers which it receives from supply conveyor 12 (see FIG. 18) and is provided with a stationary lifting ramp 26 generally adjacent the right end thereof viewing FIG. 4, which is inclined upwardly and away from the side of receiver 22 nearest the supply conveyor 12. A supporting roller 28 is located immediately adjacent the inboard termination of the ramp 26 and is coextensive in length therewith. Ramp 26 and roller 28 cooperatively function to cause the incoming newspaper N to bend and be raised up slightly, as illustrated in FIG. 18, such that a transverse ridge is formed in newspaper N running right-to-left as the machine is viewed in top plan. Such ridge serves to stiffen the newspaper and permit it to be pushed at highspeeds into the awaiting open bag without buckling or other adverse effects, as illustrated schematically in FIG. 18A and discussed hereinafter in detail. The roller 28 also helps to minimize the frictional resistance of the incoming newspaper N to proper delivery within the receiver 22 prior to subsequent bag inserting movement. Overhead deflecting shields 30, 32 and 34 on the machine 10 help guide the received newspapers into their proper positions within the receiver 22.

In order to move the newspapers from the receiver 22 leftwardly to the inserting station 20, a system of pushers is utilized. In this respect, the pushing mechanism includes a series of four individual, generally L-shaped pushers 36 of identical construction and configuration which depend from an overhead drive chain 38 operating in a horizontal plane above the inserting station 20 and the receiver 22. The endless chain 38 is positioned such that it has a pushing or operating run 38*a* extending lengthwise down the center of the machine 10 beginning to the right of the receiver 22 and terminating at a point substantially leftwardly beyond the inserting station 20 such that the individual pushers 36 move successively down the center of the machine 10 from right to left, viewing FIG. 4 for example. The return run 38*b* of the chain 38 is along the outboard side of the machine 10 remote from the supply conveyor 12 so that after completing their newspaper pushing tasks, the pushers 36 return successively to the receiver 22 along a portion of the machine 10 in which they are out of the area of movement of the newspapers being bagged. An upwardly and rearwardly extending tang 40 at the rear extremity of each of the pushers 36 helps prevent entanglement of the plastic bags into which the newspapers are inserted with the pushers 36, as will hereinafter become apparent.

Figure 19:
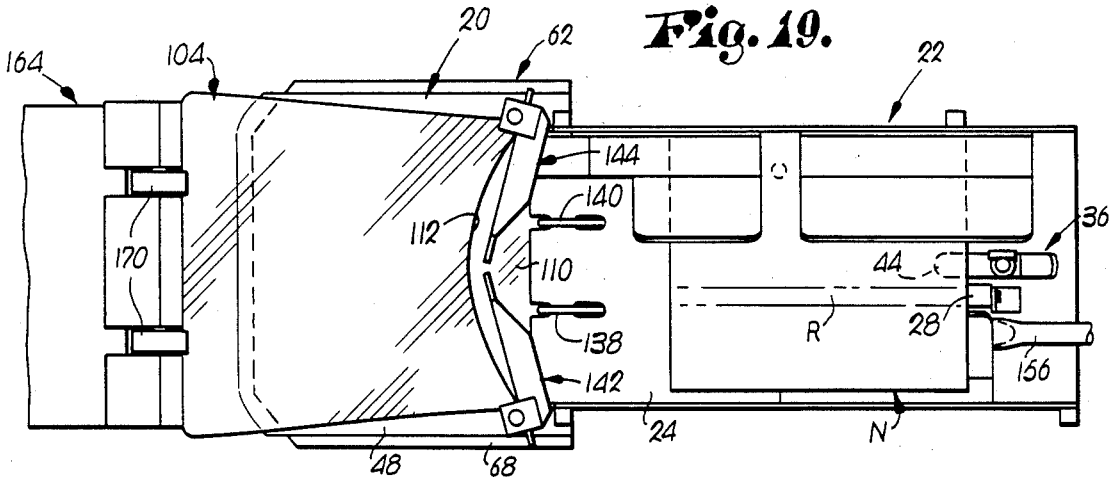
FIGS. 19–23 are schematic, fragmentary plan views illustrating the progress of a newspaper throughthe bag inserting machine and the sequence of steps involved in such process.

Each of the pushers 36 also has a rubbercoated, upright shank 42 and a horizontally extending, forwardly projecting leg 44 at the lower end of the shank 42. Leg 44 is disposed to move through the receiver 22 at only a short distance above the floor 24 during the operating run 38*a* of the drive chain 38 such that, as illustrated in FIGS. 18 and 19 for example, the leg 44 will be disposed underneath the slightly raised newspaper N at the receiver 22 when the pusher 36 first encounters the newspaper. Consequently, the upright shank 42 then serves as a pushing backstop for the newspaper such that as the pusher 36 continues leftwardly toward the inserting station 20, the newspaper is likewise moved in that same direction. The rubber coating on shank 42 cushions the impact of pusher 36 against the newspaper, particularly against any hard slick inserts which might otherwise be propelled forwardly out of the newspaper, and prevents the newspaper from "climbing up" the shank when the shank engages the soft edge of the paper. As illustrated in FIG. 18, a photoelectric sensor 46 above the receiver 22 senses the presence of a newspaper N at the receiver 22 when the next pusher 36 is approaching receiver 22 so as to allow the drive chain 38 to continue to operate. On the other hand, if no newspaper is present within the receiver 22 at the critical time, sensor 46 will cause the drive chain 38 to become disengaged temporarily from its source of driving power, thus stopping advancement of the pushers 36. Once a newspaper appears at the receiver 22 and the light beam 46*a* associated with sensor 46 is broken, pushers 36 are reactivated to continue in the usual manner.

The inserting station 20 comprises a location within the machine 10 at which newspapers from the receiver 22 are successively stuffed or inserted into plastic bags which have likewise been successively presented to the station 20. The bags are presented to the station 20 in stacks, such as the stack 48 illustrated in FIG. 5, and are retained at that location while being filled one-at-a-time from the top with incoming newspapers. Once a stack 48 has been depleted, a new stack is indexed into position to supply the needs of the next group of incoming newspapers until such supply of bags is depleted, whereupon another stack is indexed into position, and so on.

The mechanism for presenting the bags to the station 20 and periodically indexing a new stack 48 into the proper position is denoted broadly by the numeral 50 and is located below the station 20 and the receiver 22, extending lengthwise of the machine 10. The mechanism 50 includes a pair of endless, laterally spaced apart drive chains 52 and 54 (FIGS. 3, 4 and 6) moveable in respective vertical planes along opposite sides of the machine 10 and moveable in generally clockwise directions, viewing FIGS. 2 and 5. Thus, as viewed in FIGS. 2 and 5, the upper run of the chain 52 moves from left to right.

Figure 6A:
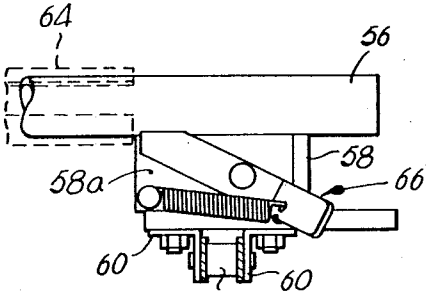
FIG. 6A is an enlarged, fragmentary detailed view of the means by which each refillable bag module is releaseably coupled onto the indexing chain mechanism of the bag inserting machine.

The two chains 52 and 54 of mechanism 50 are spanned by a series of nine mounting tubes 56 which are rigidly fixed to the chains 52,54 at equally spaced locations along the latter. As illustrated in detail in FIG. 6A, each of the mounting tubes 56 has a pair of generally L-shaped attaching brackes 58 at its opposite ends which are fixed to respective connectors 60 on the chains 52,54. The tubes 56, in turn, serve as means by which a corresponding number of stacks of the bags may be removably secured to the indexing mechanism 50 for movement therewith, each of such stacks being conveniently associated with other carrying and mounting structure to provide a compact bag module broadly denoted by the numeral 62.

Figure 6:
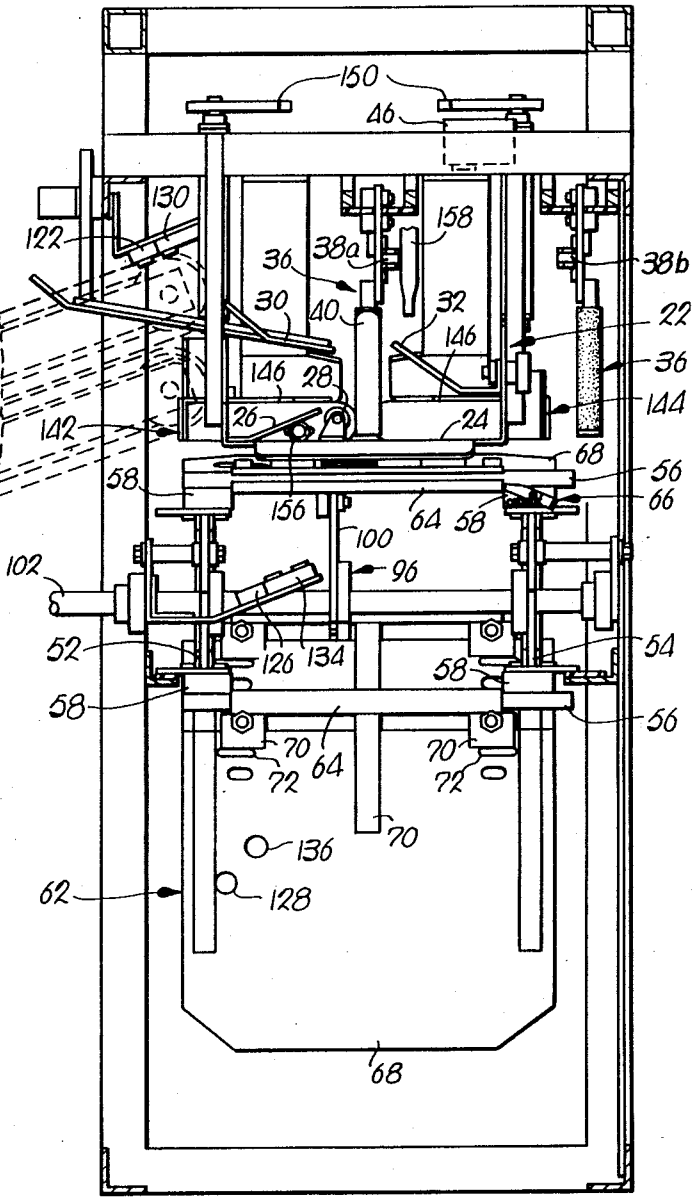
FIG. 6 is an enlarged, fragmentary, transverse vertical cross-sectional view of the bag inserting machine taken substantially along sightline 6—6 of FIG. 2.

As illustrated inparticular detail in FIGS. 8–10 and 14, each of the modules 62 includes an elongated, generally transversely C-shaped sleeve 64 having a slightly larger internal diameter than the tubes 56 on the indexing chains 52,54. Furthermore, each of the sleeves 64 is slightly shorter than the distance between the brackets 58 associated with each mounting tube 56 so as to be disposed between the brackets 58 when the module 62 is installed on the chains 52,54, as illustrated in FIG. 6. Because of the larger internal diameter of the sleeves 64 relative to their mounting tubes 56, the modules 62 may swing about tubes 56 in the nature of hinge pins during certain times during operation of the mechanism 50, and when a module 62 is rotated to a position aligning the longitudinal slot 64*a* of the sleeve with the normally vertical leg 58*a* of the corresponding pair of brackets 58, the module 62 may be removed endwise from the mounting tube 56 after a spring-loaded latch 66 has been released. This permits the supply of bags associated with the module to be replenished, as will be explained in detail hereinafter, whereupon the refilled module may be placed back on the mechanism 50 by again aligning the slot 64*a* of hinge sleeve 64 with the legs 58*a* of brackets 58 and simply sliding the module 62 lengthwise along the mounting tube 56 until sleeve 64 is onece again positioned between the two brackets 58. Latch 66 then automatically returns to its closed position to releasably hold the returned module in place.

Figure 8:
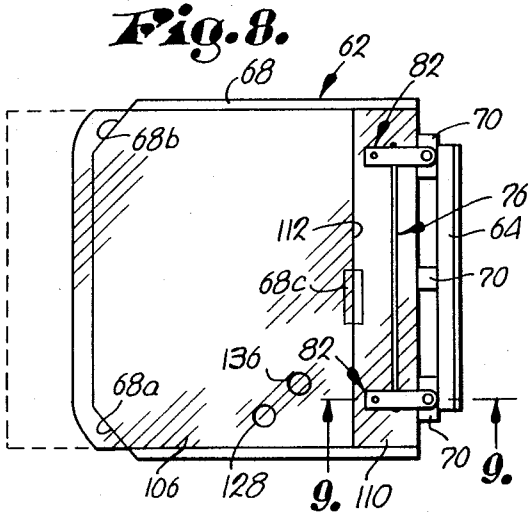
FIG. 8 is an enlarged top plan view of a typical bag module utilized in connection with the present invention.

Each of the modules 62 also includes a flat tray 68 rigidly affixed to its mounting sleeve 64 via a series of three connecting bars 70 spaced along the length of the sleeve 64. Each of the trays 68 has a pair of laterally spaced clearance slots 72 (FIG. 6) which receive the corresponding, parallel legs 74 of a generally U-shaped wicket 76 serving to stake the bags of the module into a stack and locate the same on the tray 68. As illustrated perhaps best in FIGS. 10 and 14, each of the wickets has a transversely extending bight 78 that interconnects the two legs 74. Neopreme washers 80 on each of the legs 74 immediately beneath the stack of bags and above the tray 68, as illustrated in FIG. 8, helps confine the bags in place and facilitates tearing of the bags from the wickets 76 at only the appropriate time, as will hereinafter be described. As shown only in FIG. 4, each tray 68 is provided with a pair of longitudinally extending, laterally spaced apart, friction-increasing strips 68*d* extending the full length of the top surface of the tray for engagement with the lowermost bag in the stack thereof. This helps facilitate separation of the next-to-the-lowermost bag from the lowermost bag during the bagging operation.

Figure 9:
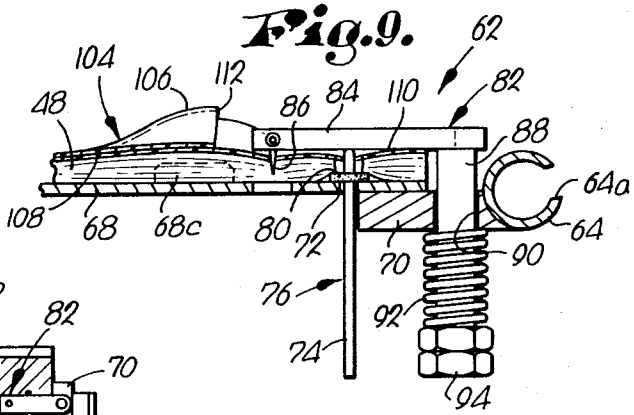
FIG. 9 is an enlarged, fragmentary cross-sectional view of the bag module of FIG. 8 taken substantially along line 9—9 of FIG. 8.
Figure 10:
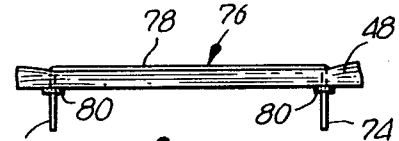
FIG. 10 is a schematic illustration on a reduced scale of a wicketed stack of bags adapted for use in connection with the bag modules of the system.

Each stack 48 of wicketed bags is retained on its corresponding tray 68 by a pair of spring-loaded clamps 82 of identical configuration. As illustrated best in-FIGS. 8 and 9, each of the clamps 82 includes a spiked hold-down bar 84 which overlies the proximal margin of the bag stack and has a depending spike 86 at its rearmost end which penetrates the top level of bags in the stack. The spikes 86 assume that the bags will remain in proper position on the tray 68 even if one or more of the bags has somehow not been proerly wicketed by wicket 76 during initial preparation of the bag stack. At its opposite end, each hold-down bar 84 ha a pivot shaft 88 fixed thereto and depending therefrom which passes through an enlarged bore 90 in the proximal connecting bar 70. The pivot shafts 88 are rotatably received within their respective bores 90 such that the hold-down bars 84 may be pivoted from their clamping positions, as illustrated in FIGS. 8 and 9, to release positions rotated 90° from the illustrated positions, wherein the bars 84 no longer overlie the tray 68. This frees the wicket 76 for removal and replacement of a new wicketed stack of bags.

It should also be pointed out that each of the bars 84 of clamps 82 is spring-loaded toward the tray 68 by a compression spring 92 coiled about a portion of the pivot shaft 88 which projects beyond the corresponding connecting bar 70. An abutment 94 on the distal end of each pivot shaft 88 respectively serves to confine the corresponding compression spring 92 between the same and the underside of the corresponding connecting bar 70.

Figure 2:
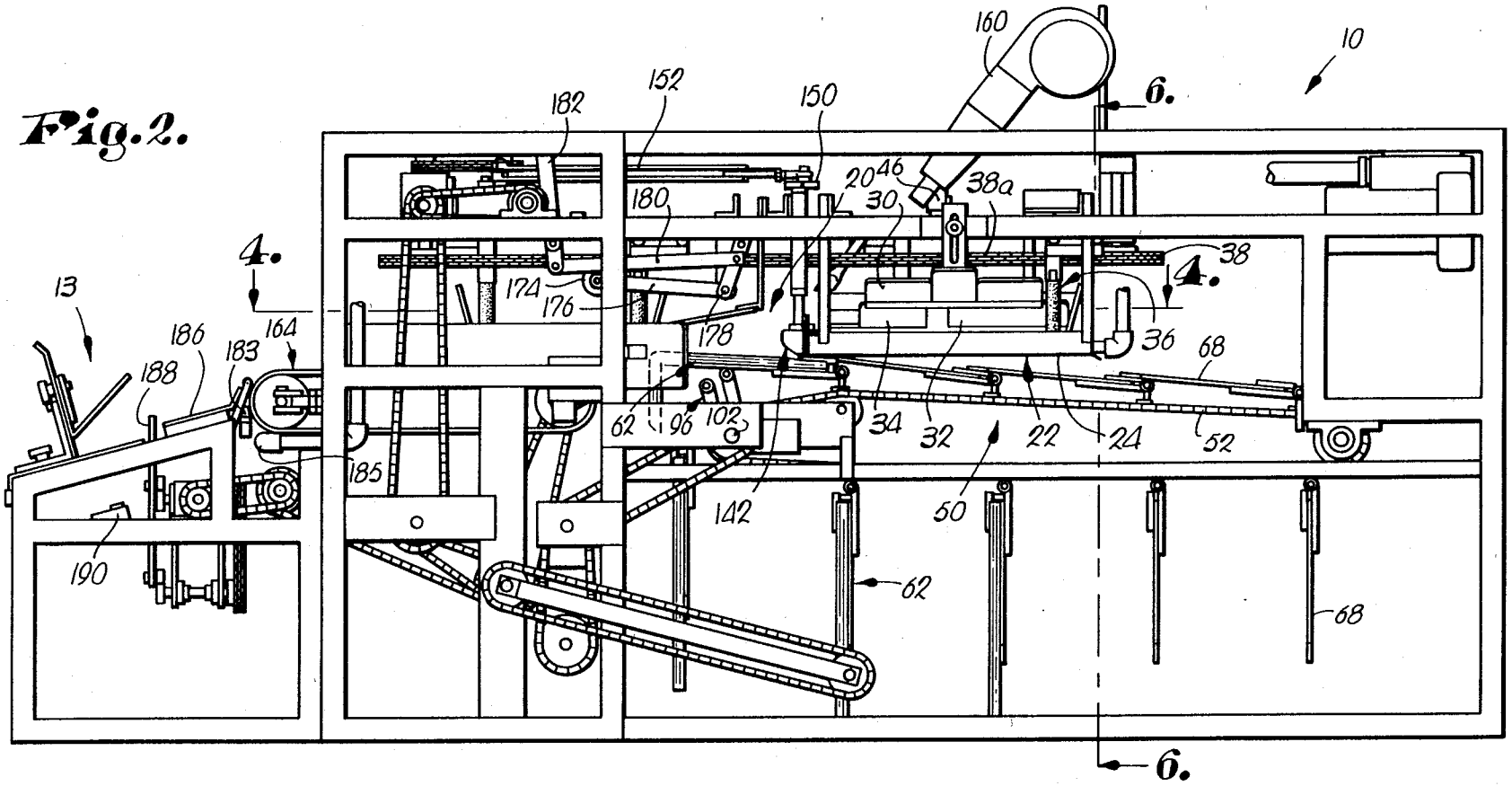
FIG. 2 is a side elevational view of the bag inserting machine of the system as viewed from that side of the machine which receives assembled newspapers from other supply apparatus.
Figure 5:
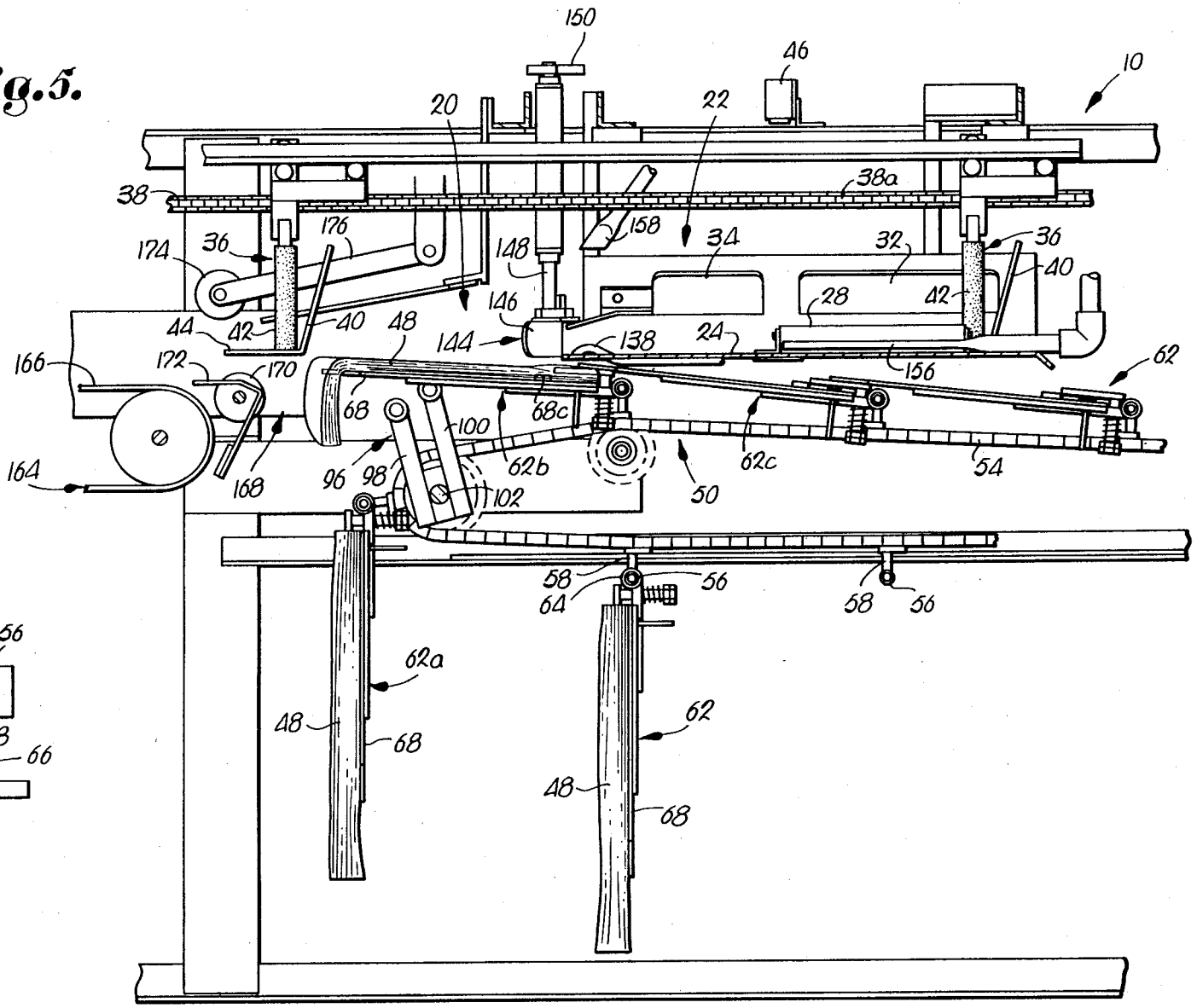
FIG. 5 is an enlarged, fragmentary, longitudinal, vertical cross-sectional view of the bag inserting machine taken substantially centrally thereof.

As illustrated best in FIGS. 2, 5 and 6, the bag modules 62 hand in an upright manner from the mechanism 50 along the lower runs of the chains 52,54 but become disposed in generally horizontal attitudes along the upper runs thereof. Structure for causing the modules 62 to be reoriented into their horizontal positions at the inserting station 20 is illustrated best in FIGS. 2, 5 and 6 and is denoted broadly by the numeral 96. As illustrated, such structure 96 includes a pair of lifting cam members 98 and 100 situated just below the inserting station 20 and fixed to and rotatable with a transverse driveshaft 102 at the downstream end of the mechanism 50. Therefore, as the shaft 102 is rotated through a single indexing revolution to bring a module 62 from the standby position illustrated by the module **62*a* in FIG. 5 to the inserting position illustrated by the module 62*b*, the two members 98 and 100 come into contacting engagement with the underside of the tray 68 to swing the latter into a horizontal mode as it arrives at the inserting station 20. The spacing between the successive modules 62 is such that with the module 62*b* arranged horizontally at station 20, the tray 68 of the next downstream module 62*c* lays upon the leading end of module 62*b* to remain in a horizontal mode. Likewise, the trays 68 of the next successive modules 62 rest at their trailing ends upon the leading end of the next preceding modules in the series so as to remain in a horizontal condition until moving around the far end of the mechanism 50, whereupon they swing down into their upright, suspended modes along the lower runs of the chains 52,54**.

Figure 15:
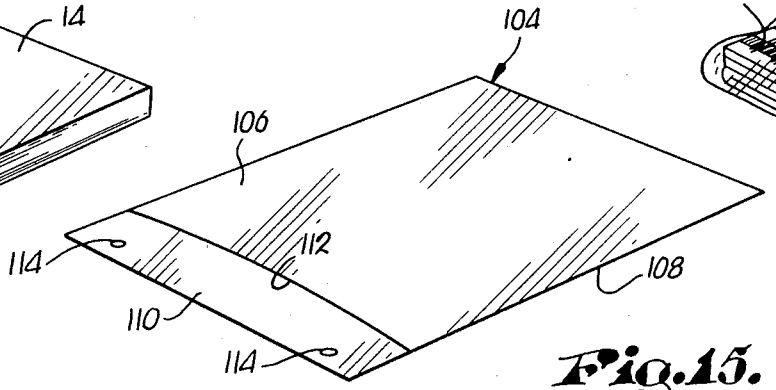
FIG. 15 is a right front perspective view of an individual bag forming a part of the wicketed stack of FIG. 14.
Figure 14:
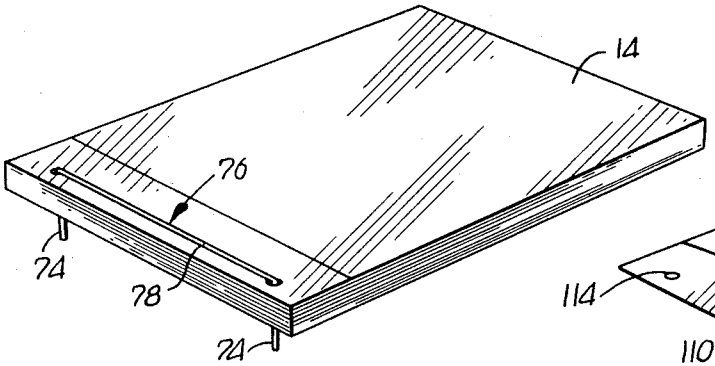
FIG. 14 is a right front perspective view of a typical wicketed stack of bags used in connection with the present invention.

FIG. 15 illustrates a suitable bag 104 for use in connection with the present invention. Bag 104 is constructed of a transparent thermoplastic material such as polyethylene and has a rectangular top wall 106 connected along three of tis extremities to a bottom wall 108. The top wall 106 is shorter than the bottom wall 108 so as to present a marginal flap or lip 110 projecting outwardly beyond a mouth 112 defined by the free edge of a top wal 106. A pair of holes 114 in the flap 110 are spaced apart in accordance with the distance between the legs 74 of the wicket 76 so as to facilitate arrangement of a number of the bags 104 into superimposed relationship with one another comprising the stack 48, as illustrated in FIG. 14, in which the wicket 76 holds and maintains the bags in their superimposed relationship. The flaps 110 of the bags 104 may also be lightlyscored from the holes 114 to the end extremity of the flap 110 to facilitate tearing removal of the bags 104 from the wickets 76 as will be later explained, such scoring not being illustrated in the drawings.

Figure 16:
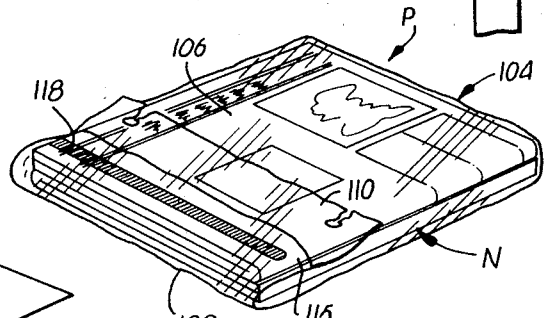
FIG. 16 is a right front perspectve view of a completely finished and sealed bagged newspaper package in accordance with the method and apparatus of the present invention.

The length of each of the bags 104 is such that the bag will confortably receive a newspaper N lengthwise, as illustrated in FIG. 16, and leave an extra margin 115 in addition to the flap 110. Thus, the finished package, as illustrated in FIG. 16 and denoted by the letter P in that figure, may have the margin 115 filded up onto overlapping relationship with the top wall 106 o the bag to effectively close the mouth 112. The margin 115 is thermally fused against the top wall 106 to present a line of seal 118 essentially across the full width of the bag, extending parallel to the mouth 112, details of such construction also being illustrated in FIG. 17. The method and means by which the line of seal 118 is produced will be explained below in connection with the heat sealing portion of the system.

One type of bag which has been found suitable for the present invention is obtainable from the Manchester Packaging Company of St. James, Mo., and is fabricated from one mil thick, heat sealable polyethylene. such a bag may typically be 17 inches wide by 20 inches long, plus a three inch lip, for a total length before folding into a packaged condition of 23 inches. Two hundred fifty to three hundred fifty bags of this type can be effectively stored on each module.

Figure 7:
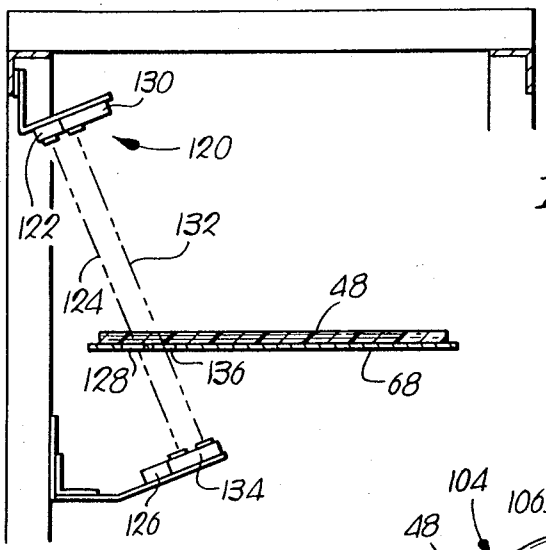
FIG. 7 is a schematic illustration of the sensing system utilized with the automatic bag moduel indexing mechanism of the invention.

The indexing mechanism 50 is designed to be automatically actuated at appropriate intervals when the stack of bags at the inserting station 20 has been depleted. In this respect, a combined photoelectric and sonic sensing system, as illustrated in FIG. 7, is provided to control such actuation of the indexing mechanism 50. Such sensing and control apparatus is denoted broadly by the numeral 120 and includes an infrared light emitting source 122 oriented to project a light beam 124 toward a detector 126 located below the level of the bag module retained at inserting station 20. The tray 68 of each module 62 is provided with an aperture 128 disposed to line up with the beam 124 when the tray 68 is in operating position at station 20, but until only a predetermined low number of bags remains on the tray (such as three or four, for example), the stack of bags is sufficiently opaque as to preclude the detection of the light beam 124 bythe detector 126. Once the supply of bags reaches the prescribed minimum level, however, the light beam passes through the aperture 128 and is detected by detector 126, which in turn is used to generate a signal by means not illustrated to slow down the entire system to a speed which will permit indexing of the next bag module into position when all of the bags of the module at the station have been totally depleted.

In order to actually trigger the indexing mechanism 50, the sensing and control apparatus 120 further includes a sonic system involving a transducer 130 above the station 20 which directs a sound wave 132 toward a detector 134 below the station 20. A second aperture 136 in each tray alongside of the aperture 128 is aligned with the transducer 130 and sonic detector 134 when the respective bag modules are situated at the station 20, but the presence of one or more bags on the tray of such module precludes the passage of the sound wave 132 through such aperture 136. Once the tray has been completely emptied, the sound wave 132 is detected by sonic detector 134, whereupon a signal is generated by means not shown to energize the mechanism 50 and rotate the drive shaft 102 thereof through one single revolution. As earlier noted, this advances the next awaiting module **62*a*, as shown in FIG. 5, into the inserting position of the module 62*b* at inserting station 20**, as also shown in that figure.

As illustrated in FIG. 5, when a bag module is at the inserting station 20 in the position of the module **62*b*, the bags are oriented in a substantially flat, horizontal condition with their closed ends drooping over the proximal end of the tray 68. This is due to the fact that the trays 68 are intentionally made significantly shorter than the bags 104 to cause the drooping action. It has been found in this respect that such drooping action is especially helpful in assuring that the topmost bag in the stack breaks away freely from the next bag therebelow during the bag opening and newspaper inserting process. Furthermore, it is to be noted that the corners 68***a* and 68*b* of the tray 68 at its downstream end are disposed at oblique angles relative to the side edges and end edge of the tray 68, which has also been found to greatly facilitate separation of the top bag in the stack from those below during high speed operation.

One apparent explanation for the more effective separating action achieved by the drooping action of the bags and the angled corners of the tray 68 is that such an arrangement causes the superimposed bags of the stack to be angled and bent at slightly different angles relative to one another, making it difficult for next adjacent bags to follow the topmost bag during the separating action. Furthermore, once the topmost bag has been filled with a newspaper, it is easier to remove from the next bag therebelow because part of the weight of the newspaper in the topmost bag overhangs and is disposed outwardly beyond the stack below it, thus decreasing the frictional force between the filled top bag and the rest of the stack.

The opposite or upstream ends of the bags, each having the entry mouth 112, are adjacent the downstream end of the receiver 22 and slightly below the latter. The mouth 112 of the topmost bag 104 is just downstream from the proximal edge of the receiver 22.

In order to open the mouth 112 for the entry of a newspaper from receiver 22, a pair of high pressure air jets 138 and 140 are positioned at laterally spaced locations near the discharge end of receiver 22 and are directed downwardly and slightly downstream so as to face the mouth 112 of the uppermost bag in stack 48. Jets 138 and 140 are controlled by mechanism not shown to be activated for only a short instant of time following removal of the previously bagged newspaper from the inserting station 20 to open the mouth 112. A centrally disposed, relatively short, bar-like projection 68*c* on the tray 68 underneath the stack of bags and in vertical alignment with the mouth 112 causes a hump in the bag stack directly above the projection 68*c* which has the effect of slightly breaking open the mouth 112 of the topmost bag to facilitate the entry of the air blasts from jets 138 and 140 to accomplish complete opening of the mouth 112.

Figure 3:
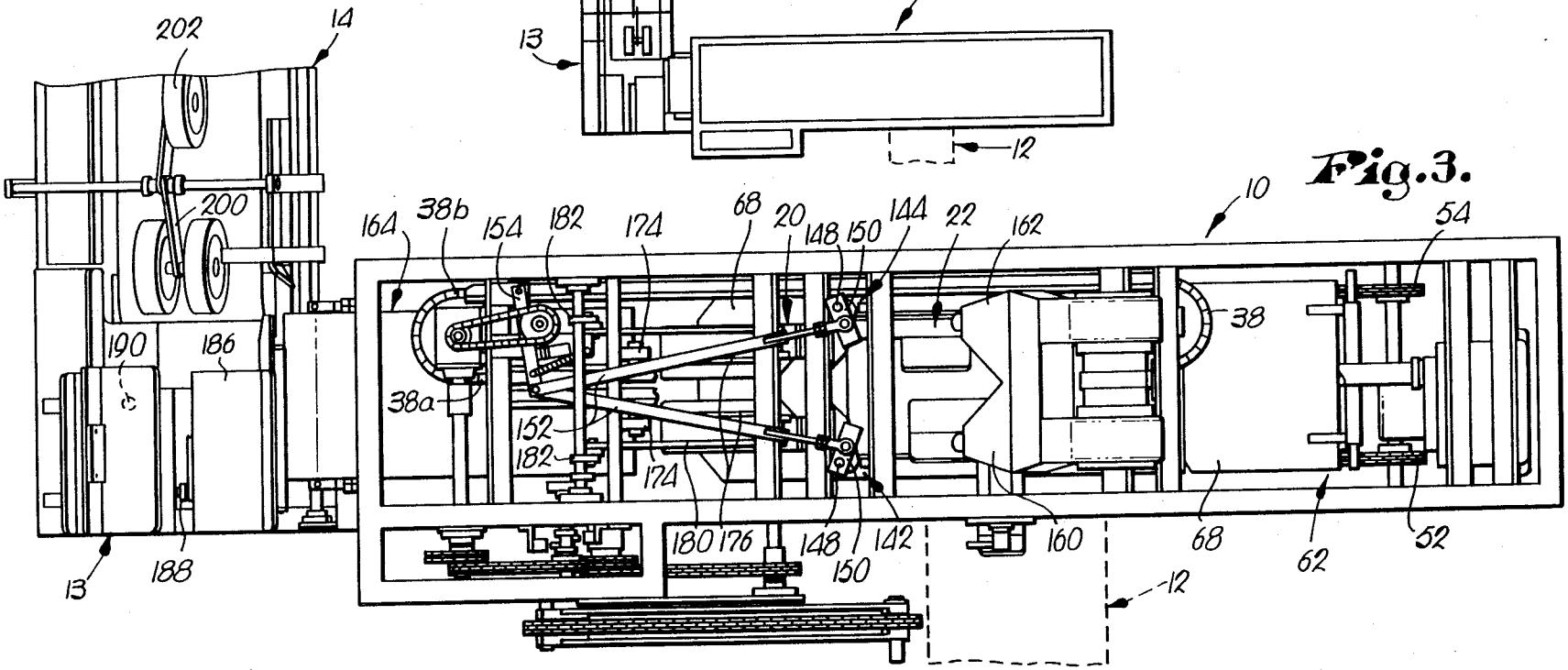
FIG. 3 is a top plan view thereof.
Figure 4:
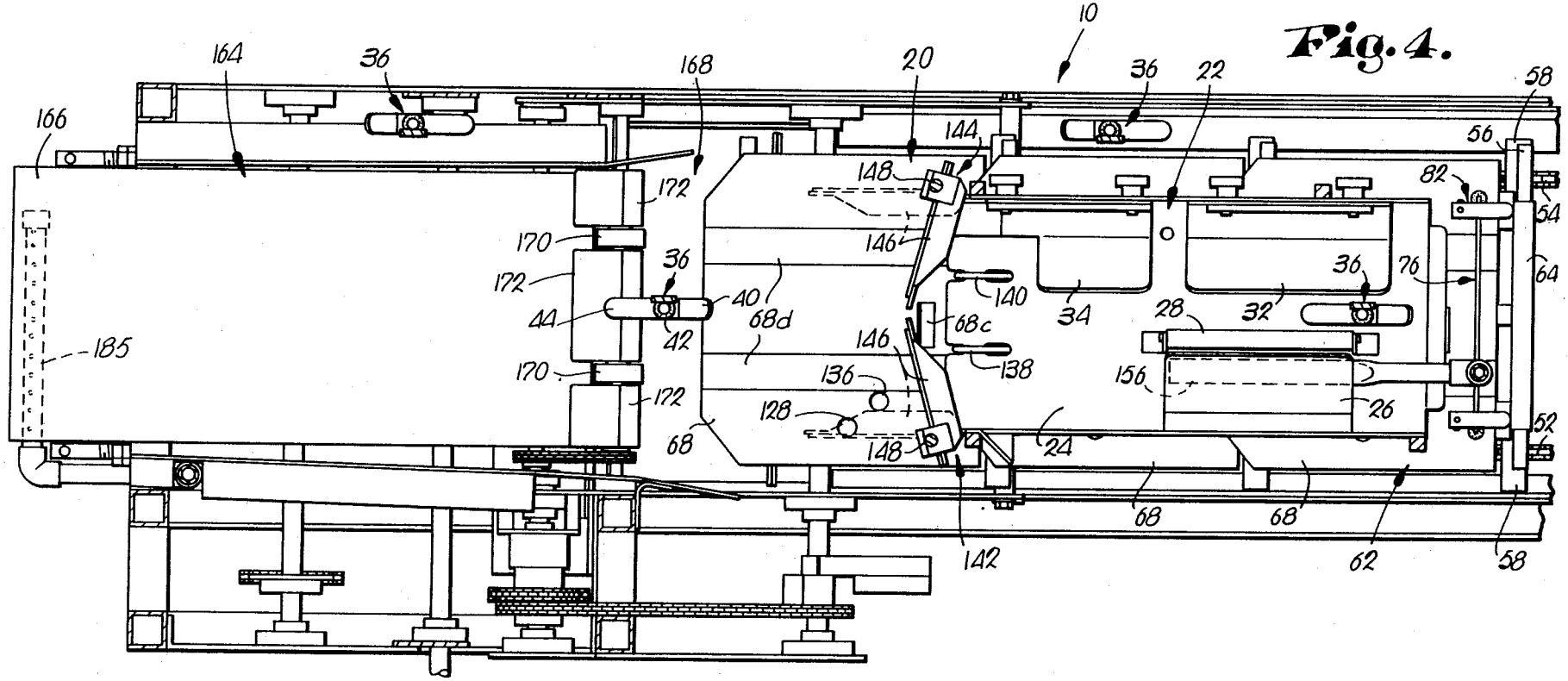
FIG. 4 is an enlarged, fragmentary plan view of the inserting station and associated portions of the bag inserting machine taken substantially along sightline 4—4 of FIG. 2 with parts broken away for clarity.

A pair of gate-like retainers 142 and 144 are located at the discharge end of receiver 22 just outboard of opposite sides of the latter for entering the top bag once the mouth 122 has been opened and for holding the bag in a fully opened condition for the oncoming newspaper. Each of the retainers 142,144 comprises a generally horizontally extending arm 146 fixed at its inner end to an upright shaft 148 just outboard of the proximal side of the receiver 22. The arms 146 of retainers 142,144 project transversely inwardly toward one another when the retainers are in the standby position of FIG. 4, but when shafts 148 are rotated approximately 90° in the appropriate directions, the arms 146 project in a downstream direction substantially parallel with one another, as illustrated in FIG. 4, in disposition for engaging the interior sidewalls of the top bag. As illustrated in FIGS. 2 and 3, the shafts 148 are driven at their upper ends by respective cranks 150, which are in turn driven by a pair of pitmans 152 coupled at one end to a cam operated swing bar 154.

The retainers 142 and 144 are assisted in maintaining the bag open by a generally horizontally extending low pressure outlet nozzle 156 (FIG. 5) lying just above the floor 24 of receiver 22 beneath the ramp 26. They are also assisted by a second inflating nozzle 158 adjacent the discharge end of receiver 22 but above the latter and projecting diagonally downwardly and forwardly with respect to the direction of paper travel. The two low-pressure nozzles 156 and 158 are controlled by valving (not shown) which causes them to stay on as a newspaper starts to approach and first enter a bag but to then shut off as the leading portion of the paper enters partially into the bag. The lowermost end of the nozle 158 is substantially in vertical alignment with the discharge end of the receiver 22, and nozzle 158 is disposed substantially centrally of the machine in a lateral sense, as illustrated, for example, in FIG. 6. As illustrated in FIGS. 2 and 3, a pair of overhead ionizing air sources 160 and 162 direct ionized air downwardly onto the bags at station 20 to eliminate the static electricity often associated with such bags and to supply additional air for use in inflating the bag and holding the same open during introduction of each newspaper. Ionizing air sources 160 and 162 are constantly operating.

A horizontal conveyor 164 is disposed in a slightly downstream position from the inserting station 20 and includes a wide, endless platform belt 166 having an upper stretch running from right to left viewing FIGS. 4 and 5, for example. Conveyor belt 166 is utilized to transport the bagged newspapers away from the inserting station 20 and toward the sealing machine 14 but, as will be apparent from vieing FIG. 5 (also FIG. 4), a gap denoted generally by the numeral 168 is defined between the entry end of the conveyor belt 166 and the downstream end of the bag tray at station 20. As illustrated in FIG. 5, and as mentioned above, the excess ends of the bags in stack 48 at station 20 droop over the end of the tray 68 and hang into the gap 168 but, as will be explained later in detail, when the top bag becomes inflated and filled with an incoming newspaper, the downstream end portion is raised up into a horizontal condition and projects into partially overlapping relationship with a pair of lower grab roller 170 spaced slightly upstream from the entry end of the conveyor belt 166 and located at laterally spaced locations across the path of travel of the newspapers. Several formed metal shieldings 172 are looped around the drive shaft of rollers 170 between the latter and also outboard thereof to prevent snagging of any plastic bag material on such shaft, and also to facilitate entry onto the conveyor belt 166. When the top bag is first inflated, the closed end thereof starts to lift up into a horizontal condition to facilitate entry of the oncoming newspaper. As the closed end rises up, it engages the lower grab rollers 170, which immediately cause the closed end to pop up completely into the horizontal mode.

Cooperating with the lower grab rollers 170 is an upper pair of rollers 174. Each of the rollers 174 is rotatably carried by the outer end of its own L-shaped bell crank 176 pivotally connected to the frame of the machine by a transverse pivot 178. The generally upwardly projecting arm of each bell crank 176 is, in turn, operably coupled with a fore-and-aft extending operating link 180 which is coupled at its opposite end with a cam operated, fore-and-aft oscilliating swing bar 182. A return spring (not shown) connected between the frame of the machine and the uppermost end of each bell crank 176 causes the upper grab rolers to be urged downwardly toward the lower grab rollers 170, but in response to cam operation of the swing bars 182, the rollers 174 lift off the lower grab rollers 170 to release the bagged newspaper that has been transferred onto the entry end of the conveyor belt 166. Of course, it is the lwoer grab rollers 170 which are driven, whereas the upper rollers 174 are free wheeling, and opening and closing of the grab rollers 170, 174 is timed with movement of the newspaper along its path of travel so that the rollers 170, 174 clamp down onto a newspaper after insertion thereof into the bag, rather than before such insertion has occurred.

The conveyor 164 is disposed to discharge the bagged newspaper package onto the direction changing unit 13 situated at the leftmost end of the machine 10. At the discharge end of belt 164 a pair of air supplying jets 183 and 185 respectively. The jet 185 is in the nature of a tube or manifold extending transversely across and below the discharge end of the conveyor 164 for the continuous discharge of relatively low pressure air upwardly between the conveyor 164 and direction changing unit 13. This keeps the trailing end of the unsealed newspaper package up in proper position during transfer from convey 164 to unit 13. On the other hand, the jet 183 supplies high pressure ionized air that is controlled to be actuated only for the short interval during which the trailing end of the unsealed newspaper package passes overhead. This keeps the plastic bag from clinging to the belt 166 of conveyor 164 as belt 166 moves around the discharge end of its path of travel. A stationary receiving tray 186 accepts the newspaper package from the conveyor 164 and causes the received package to be disposed in a slightly tilted condition with the mouth end of the bag somewhat higher than the opposite, closed end thereof.

A crank-operated pusher 188 having a relatively short throw moves in a circular path of travel in a plane that is at right angles to the path of travel of the newspapers through the bagger 10 and is timed to be retracted below the receiving tray 186 until the next newspaper package has been delivered into the latter, whereupon the pusher 188 moves through its upper portion of travel to engage the newspaper package from one side thereof and propel it toward the bag sealer 14. A photoelectric detector system 190 associated with the direction changing unti 13 so controls the operation of the pusher 188 that unless a newspaper package is received within the overhead tray 186, the pusher 188 will not be permitted to complete its upper portion of cyclic movement and will, instead, be stopped in a retracted condition below the tray 186.

Bag Sealer

Figure 11:
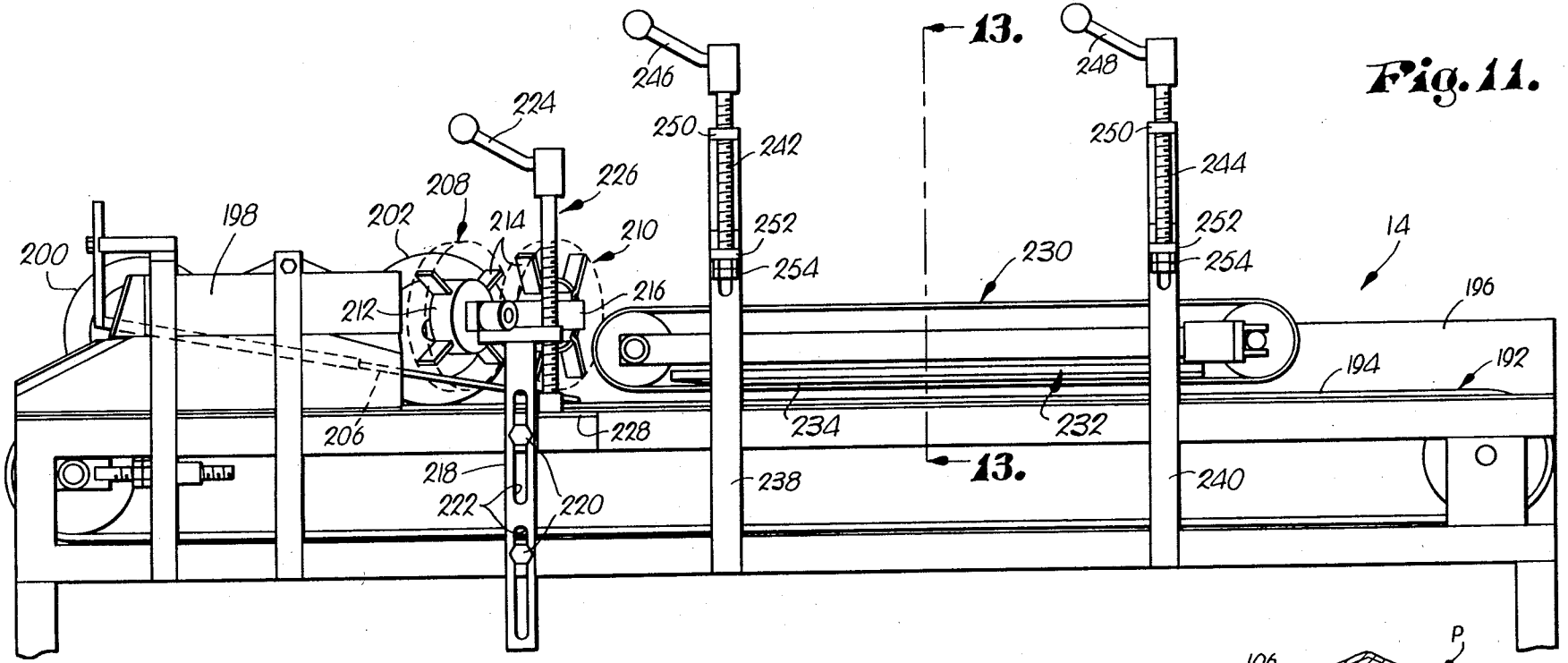
FIG. 11 is a fragmentary, side elevational view of the bag sealing machine of the system.
Figure 13:
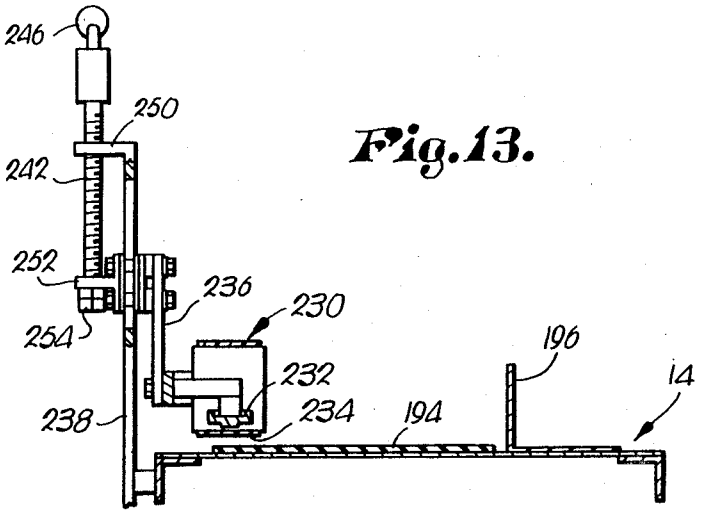
FIG. 13 is a fragmentary, transverse cross-sectional view of the sealing machine taken substantially along line 13—13 of FIG. 11.
Figure 12:
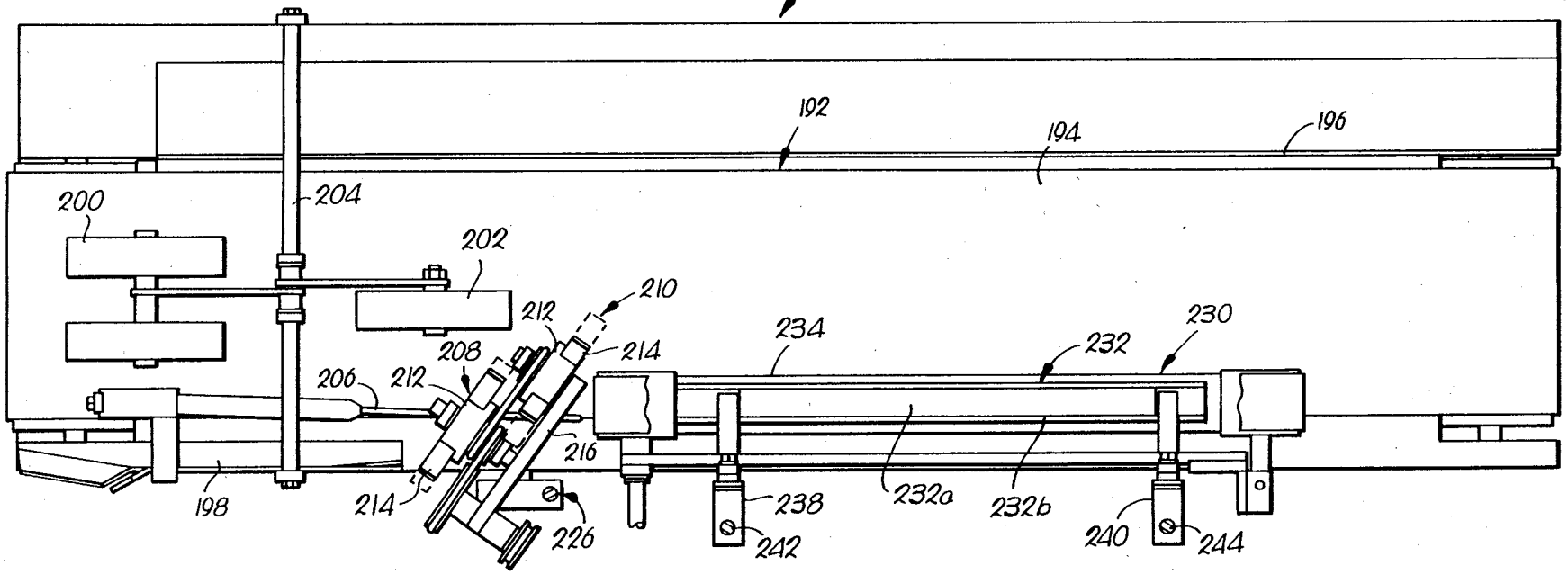
FIG. 12 is a top plan view thereof.
Figure 12:
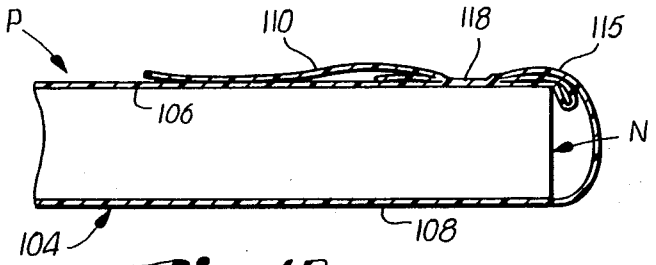

The sealing machine 14, as shown in detail in FIGS. 11, 12 and 13, includes a conveyor 192 which, although shown in plan in FIGS. 12 and 13, is disposed at an inclined angle corresponding to that of the receiving tray 186 associated with the direction changing unit 13. Such angular orientation of the conveyor 192 is illustrated, for example, in the schmatic illustrations of FIGS. 25 and 27. The conveyor 192 includes a wide, flat belt 194 extending over the full length of the sealer and moveable in a direction from left to right, viewing FIGS. 11 and 12. An upstanding, longitudinally extending wall 196 along the lower edge of the conveyor belt 194 retains the newspaper packages in place on belt 194 as the latter operates. On the opposite, slightly elevated side of the conveyor 192, a generally upstanding deflecting shield 198 is located adjacent the entry end of belt 194 in disposition for engaging the margin 115 on the newspaper package in preparation for folding of such margin into position for sealing. A pair of overhead hold-down wheel assemblies 200 and 202 are independently rockable on a common shaft 204 traversing the machine 14 generally adjacent the entry end of the latter for gravitational bearing against the newspaper packages as they pass therebeneath on the conveyor belt 194 to assist in maintaining such packages flatly against the belt 194 just prior to and during folding of the margin 115 into a position for sealing.

As illustrated best in FIGS. 11 and 12, a folding assist rod 206 generally adjacent the entry end of the conveyor 192 extends in a downward direction from its upstream-most end along the uphill side of the belt 194 and terminates in a lowermost tip spaced only slightly above the belt 194 at its uphill edge. The rod 206 is thus in a disposition to bear against the margin 115 of the bagged package as the latter moves along the conveyor belt 194 and to hold the contacted portion of the bag and adjacent loose portions of the upper wall 106 of the bag in a fixed position relative to the margin 115 as the latter is folded into place by a pair of obliquely disposed, overhead folding wheels 208 and 210. Each of the wheels 208, 210 includes a central hub 212 provided with a plurality of radially outwardly extending, resilient fingers 214 which may, for example, be constructed from pieces of flat, cord-reinforced, rubber-coated belting material.

The wheels 208, 210 are continuously driven by suitable drive belting and are supported on a common horizontal arm 216 extending inwardly at an oblique angle to the conveyor belt 194 and partially overhanging the same. The arm 216 is in turn supported by an upright 219 (FIG. 11) adjustably secured to the frame of the sealer 14 by bolts 220 pasing through slots 222 in the upright 218. Bolts 220 are maintained snug, but not tight, against upright 219 so as to permit sliding vertical adjustment of the upright 218 relative to bolts 220. The handle 224 of an upright, threaded adjuster 226 threadably engaged with a lateral extension of the upright 218 and bearing aganist a proximal shoulder 228 of the sealer frame may be rotated to cause the upright 218, and thus the folding wheels 208 and 210, to be either raised or lowered.

Figure 27:
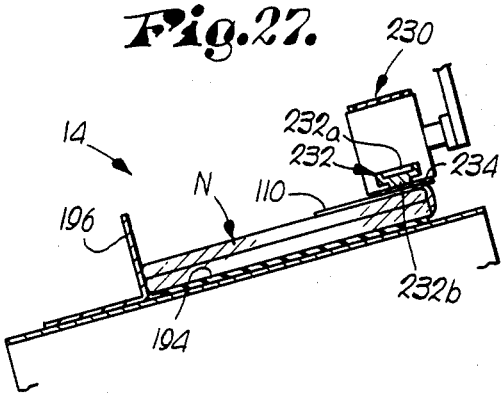
FIG. 27 is a fragmentary, schematic, transverse cross-sectional view through the upper portion of the bag sealing machine illustrating the manner in which the heating element fuse the marginal bag portion to the top wall of the package.
Figure 26:
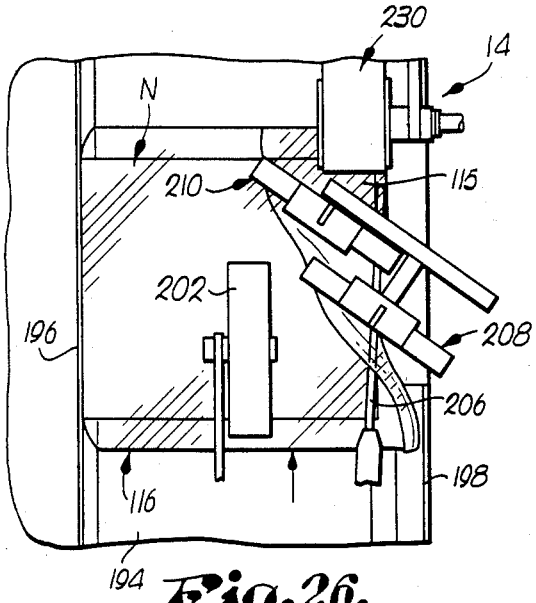
FIG. 26 is a fragmentary top plan view of the apparatus illustrated in FIG. 25 with the marginal bag portion partially folded over.

A heating element broadly denoted by the numeral 230 is disposed downstream from the folding wheels 208 and 210 along the uphill edge of the conveyor belt 194 for heat sealing the bag into a closed condition. In this respect, the heating element 230 includes an elongated, longitudinally extending, electrically powered heating bar 232 supportec within an endless, horizontally and longitudinally extending, thin heat transfer belt 234, preferably constructed of a fiberglass reinforced, tetrafluoroethylene material. As illustrated in FIG. 27, the heating bar 232 more specifically includes a rectangular in cross-section, elongated member **232*a* directly connected to the source of electrical current and a machined aluminum casing 232*b* which receives and is affixed to the member 232*a*. The aluminum casing 232*b* is so shaped as to cause heat to be concentrated in a narrow band along the bottom thereof such that heat is correspondingly transferred in a narrow line of seal 118 of the newspaper package P. In effect, the aluminum casing 232*b* acts like the bottom of an iron to transfer heat evenly and hold the heat as the newspaper packages pass therebeneath. As illustrated in FIGS. 11 and 13, the heating bar 232 is disposed closely adjacent the lower run of the heat transfer belt 234 so as to be in intimate heat transfer relationship therewith. Belt 234 is driven at the same linear speed as the conveyor 194 and is spaced above the latter a distance which insures contacting engagement between the lower run of the belt 234 and the newspaper package moving along belt 194. As illustrated in FIG. 13, the heating element 234 is disposed laterally inwardly from the uphill side of the conveyor 192 such a distance that the heating element 230** will actually overlie a portion of a newspaper within the bag as it passes therebeneath.

The heating element 230 is free to float upwardly to the extent necessary to permit the newspaper package moving therebeneath to pass without hinderance. In this respect, the element 230 is supported by carriages 236 which may be adjustably shifted upwardly and downwardly along a pair of longitudinally spaced apart uprights 238 and 240 affixed to the frame of the sealing machine 14. The carriages 236 may be adjusted upwardly or downwardly along the uprights 238 and 240 by a pair of upright adjusting screws 242 and 244, having respective operating handles 246 and 248 at their uppermost ends. The screws 242, 244 are threaded into respective, outturned portions 250 of their respective uprights 238 and 240 and pass loosely through outwardly projecting ears 252 on the carriages 236. Jam nuts 254 on the lower end of each screw 242,244, prevent the carriages 236 from dropping off the lower ends of the screws 242,244 and cause the carriages 236 to be lifted with the screws 242,244 when the latter are operated by the handles 246,248. If need be, the screws 242,244 can be adjusted slightly relative to one another so as to slightly tip the heating element 232 ina fore-and-aft direction, such being permitted by the two independent carriages 236 for the two opposite ends of the element 230.

Operation

The operation of the bagging system of the present invention should be readily apparent from the foregoing detailed description. However, the following brief remarks may also be referred to for a further understanding of the operation of the system and the steps involved in completing the desired newspaper packages P in the form illustrated in FIG. 16.

As remarked earlier, the system of the present invention contemplates a continuous, nonstop operation in which newspapers are fed into the system at a metered rate of flow via the supply conveyor 12, are inserted into the bags by the inserting or bagging machine 10, are heat sealed in a closed, finished package by the sealing machine 14, are conveyed to a stacker-counter 18, adn are placed in stacks of several packages each by the stacker-counter 18 for manual removal and subsequent handling.

Referring now in particular to schematic illustrations in FIGS. 18–29, it will be seen that the newspapers N are received seriatim from the supply conveyor 12 by the receiver 22. Quite typically, a single newspaper N will actually consist of a multiplicity of half-folded newspaper sections nested one within the other, with two or more nested assemblies stacked one on top of the other, as illustrated in FIG. 18. It will, of course, be understood, however, that the principles of the present invention are equally applicable to newspapers having only a single nested assembly of sections or more than two such assemblies, the particular form of the newspaper N shown in the drawings being for purposes of illustration only.

When the components of the bagging machine 10 are in the condition illustrated in FIG. 19, the newspaper N has just been received within the receiver 22 and the next pusher 36 is situated just off to the right of the newspaper, although it is to be understood that the pusher 36 has been making a continuous, non-stop loop of travel. By this time the high pressure air jets 138 and 140 have directed blasts of air at the mouth 112 of the top bag 104 at the inserting station so as to open the mouth 112. The central, hump-causing projection **68*c* has adequately distorted the mouth 112 of the uppermost bag in the stack to facilitate the instantaneous entrance of air streams from jets 138 and 140 into the mouth 112 to open the same. Simultaneously, air from the low pressure nozzles 156 and 158 enters the opened bag 104 and causes it to inflate. At this time the retainers 142 and 144** are in their closed or standby positions, generally facing one another.

Due to the presence of the ramp 26 and the cooperating roller 28 at receiver 22, the newspaper N is bent slightly while it awaits the next oncoming pusher 36. Such bending action causes a transverse stiffening ridge to form in the newspaper N similar to the ridge R illustrated in FIG. 18A. It will be noted that the ridge R thus extends in the longitudinal direction of paper movement and toward the inserting station 22.

Figure 20:
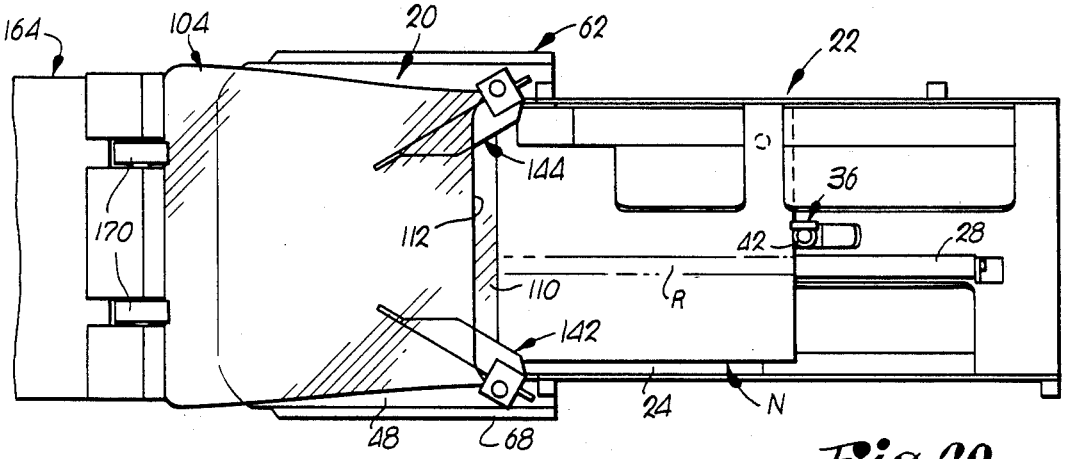

As the next pusher 36 pushes the newspaper N leftwardly, as in FIG. 20, from its initially received position, the stiffening ridge R prevents buckling of the newspaper and helps keep the leading edges of the newspaper from being folded back due to rebounding, turbulent air escaping from within the inflated bag. The retainers 142 and 144 are swung toward their open positions, entering the bag 104 through the mouth 112 to prepare the bag 104 for the oncoming newspaper N, and then the newspaper N passes over the laid out, flat flap 110 of the awaiting bag 104 and starts to enter the latter through the mouth 112.

Figure 18A:
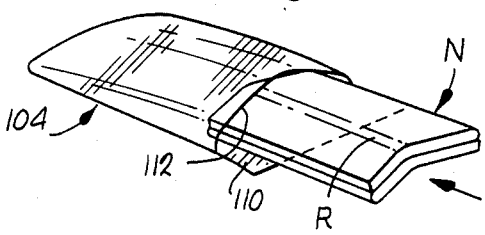
FIG. 18A is a left front perspective view of a ridged newspaper partially inserted into an open bag.
Figure 21:
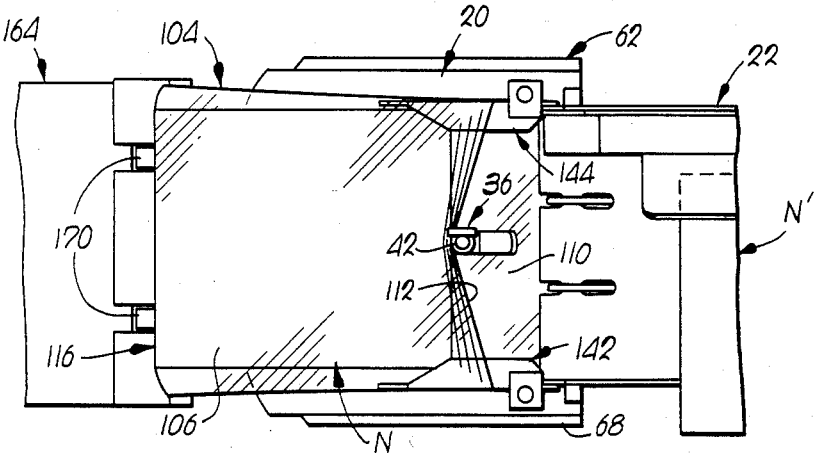

The retainers 142 and 144 complete their opening movement to the positions illustrated in FIG. 21 and remain in that position as the newspaper N continues to enter the bag 104 as illustrated also in FIG. 18A. At approximately the point of news paper entry as illustrated in FIG. 18A, the leading edge of the newspaper N is slightly inboard of the mouth 112 and the low pressure air from outlets 156 and 158 is shut off. Also at this time the ridging effect of the newspaper tends to be dissipated since the newspaper has left the underlying ramp 26 and roller 28. Moreover, with the termination of escaping air flow and the continued contact of the interior of the bag with the leading edge of the newspaper, there is decreased likelihood from this point on that the leading corners or edges of the newspaper N will somehow be folded back during continued inserting movement of the newspaper N.

As the newspaper N is inserted the rest of the way into the bag 104 by the pusher 136, which by this time, as illustrated in FIG. 21, has moved into position above the retained flap 110 of the bag 104 and has started to pull against and crumple the top wall 106 of the bag. Note also that by this time the next newspaper N′ has been received in the receiver 22. Also by this time it will be noted that the downstream end of the unsealed package 116 formed by the newspaper N and the bag 104 which receives it has stretched into overlapping relationship with the grab rollers 170.

Figure 22:
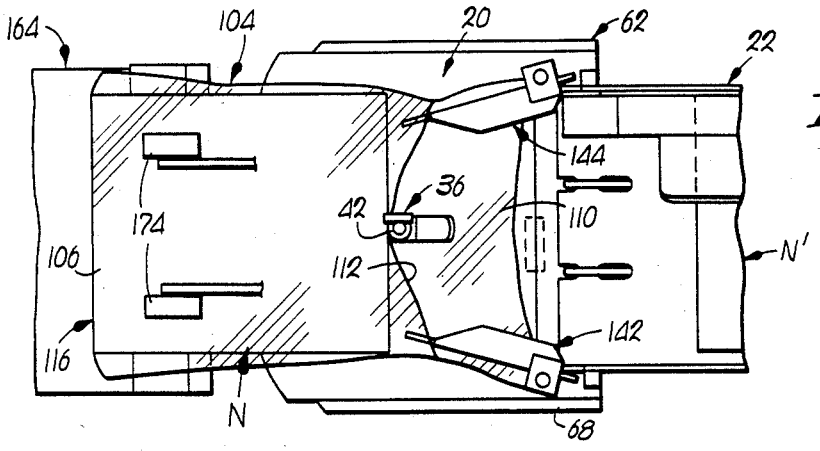

Referring to FIG. 22 it will be seen that as the pusher 136 moves slightly further downstream from its FIG. 21 position, the bag 104 is torn free from its wicket 76 to completely release the unsealed package 116 from the station 20 and at this same time, the upper grab rollers 174 clamp down against the package to cause it to forcefully engage the lower rollers 170. Consequently, through the combined pushing action of the pusher 136 and the pulling action of the rollers 170, the package 116 is propelled away from the inserting station and onto the entry end of the conveyor 164. Note at this time that the retainers 142 and 144 have commenced returning to their original, closed positions.

Once the entire unsealed package 116 is received onto the conveyor 164, the package starts to move away from its pusher 136 due to the faster lineal speed of the conveyor 164 than the pusher 136. This acceleration of the package prevents it from clinging to the pusher 136 as the latter completes its path of travel and turns toward the outboard, return leg of its journey.

Figure 23:
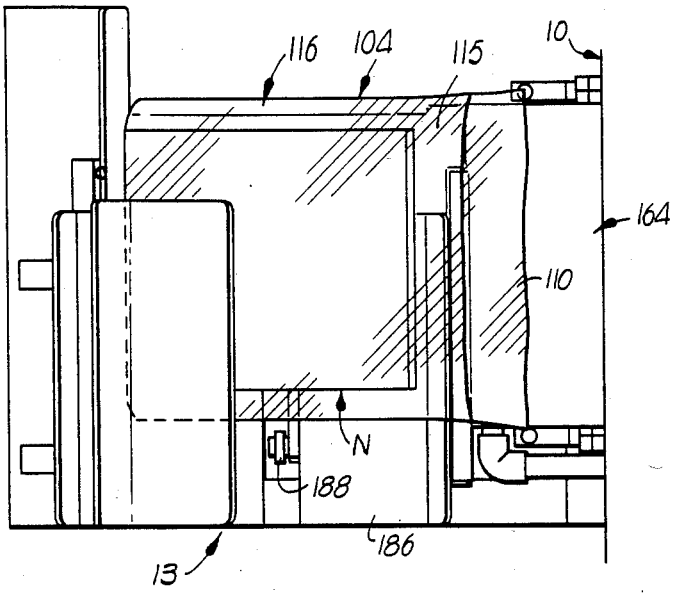
Figure 24:
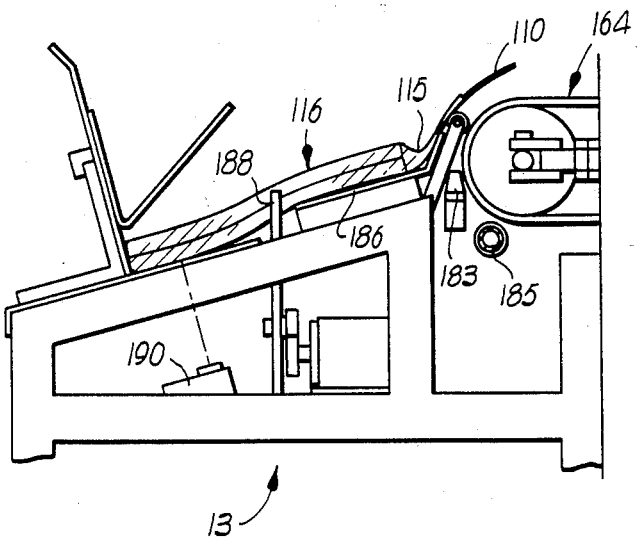
FIG. 24 is a schematic, fragmentary, elevational view of the discharge end of the bag inserting machine and the direction changing unit for introducing the partially packaged newspaper into the heat sealing machine.
Figure 25:
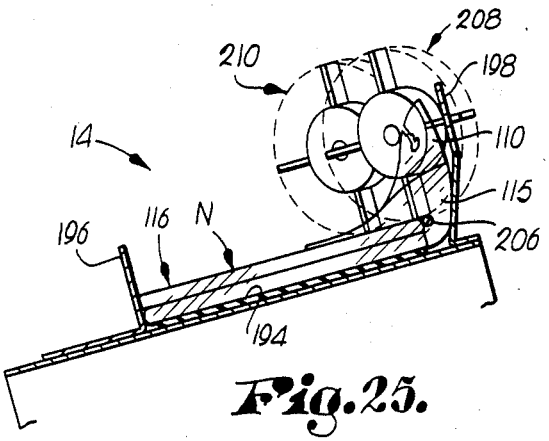
FIG. 25 is a fragmentary, schematic, transverse cross-sectional view through the upper portion of the bag sealing machine illustrating the manner in which the marginal portion of the bag is folded over into proper position for sealing.

After being moved away from the inserting station 20 by the conveyor 164, the unsealed package 116 is discharged by the conveyor 164 onto the inclined receiving tray 186 of the direction changing unit 184, as illustrated in FIGS. 23 and 24. The package 116 is thereupon engaged by the right angle pusher 188 which shoves the package onto the awaiting conveyor 192 of the heat sealing machine 14. As the package 116 moves along the conveyor 192, the excess margin 115 engages the deflecting shield 198 and is brought to a generally upstanding condition, as illustrated in FIG. 25. Substantially at the same time, the margin 115 moves under the inclined rod 206 which progressively pulls the excess margin 115 downwardly around the proximal end of the contained newspaper N to facilitate the proper folding over of the margin 115 as the latter then encounters the folding wheels 208 and 210. Note in FIG. 26 that as the package 116 continues under the wheels 208 and 210, the fingers 214 progressively engage the margin 115 along the length thereof to fold it neatly over and around the rod 206, causing the marginal flap 110 to become superimposed on the top wall 106 of the bag.

Figure 28:
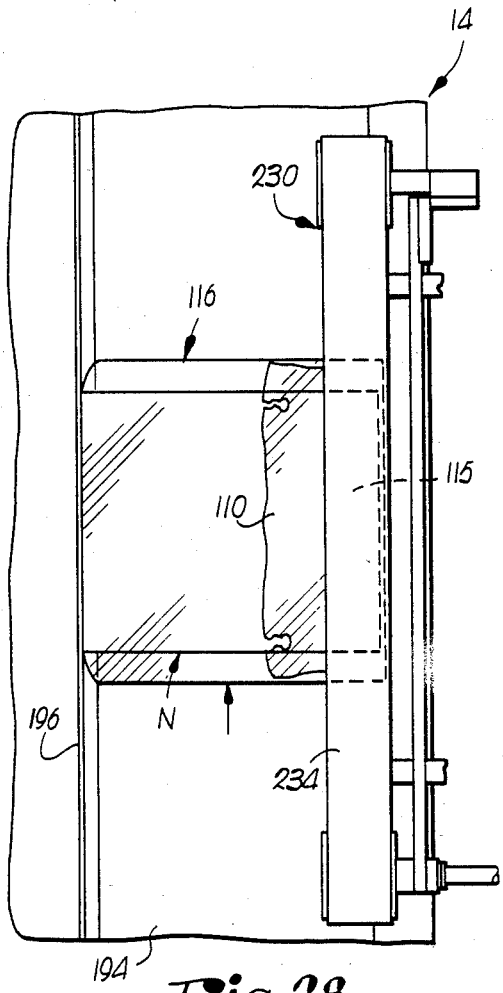
FIG. 28 is a fragmentary, schematic, top plan view of the apparatus illustrated in FIG. 27 as the newspaper package is being heat sealed.
Figure 29:
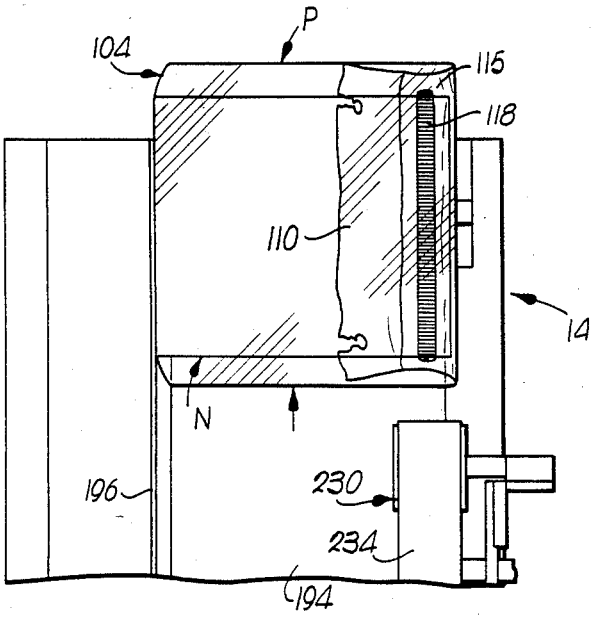
FIG. 29 is a fragmentary, schematic, top plan view of the discharge end of the heat sealing machine showing the fully heat sealed newspaper package.

After the margin 115 has been folded into position by the wheels 208 and 210, the package 116 passes under the heat sealing element 230, as illustrated in FIGS. 27 and 28. Because the heat transfer belt 234 of element 230 is moveing at the same lineal speed as the package, there is no relative movement between the belt 234 and the package 116. Consequently, an even, effective transfer of heat from the belt 234 to the bag 104 occurs over the full length of the heating element 230, causing the margin 115 to be fused to the top wall 106 of the bag along the line of seal 118, as illustrated in FIGS. 16 and 29. Note in this respect that because the heating element 230 is disposed to overlie the inserted newspaper N as well as the bag itself, the newspaper serves as a heat sink for the heat transferred by belt 234 to the bag. Consequently, greater heat can be applied through the element 230 than might otherwise be the case, which assures that a secure and complete seal of the margin 115 will be obtained by the time the package 116 reaches the end of the heating element 230.

It should be noted that the line of seal 118, in the finished package P of the illustrated embodiment, is not located in the flap 110 which extends beyond the mouth 112, but rather is located in a marginal excess portion 115 of the bag provided by virtue of the fact that protective envelope defined by the bag is longer than the corresponding length of the newspaper. Thus, the marginal excess 115 can be folded over, along with the flap 110 that provides material for wicketing to the tray, such that the line of seal 118 is through the double wall thickness of the bag at a location just inboard of the mouth 112. Consequently, the mouth 112 is fully and tightly sealed to preclude the escape of the contained newspaper and to prevent the admittance of moisture and other environmental substances.

The foregoing described process continues on a nonstop basis so long as additional newspapers continue to be supplied to the bagging machine 10. As the supply of one bag module 62 at the inserting station 20 becomes depleted, such conditionis detected bythe sensing and control apparatus 120, illustrated in FIG. 7, to initially slow down the system while the last bag at the station 20 becomes pulled off its wicket and while the next module is indexed into position by the mechanism 50, whereupon the system is automatically sped back up to its normal operating speed. As the bag modules 62 move around the right end of the indexing mechanism 50, as viewed in FIG. 2, and hang downwardly into upright positions, they may be readily removed by releasing the latches 66 associated therewith and slipping the modules endwise off the crosspipes 56. It is then a simple matter to remove the existing empty wicket 76 and replace the same with a full wicketed stack of bags. The refilled module then may be readily slipped onto the awaiting mounting tube 56, whereupon the module is again in condition for being indexed up into the bag inserting station 20.

It is to be noted that because positive pressure air streams are utilized to both initially open a bag and subsequently inflate the same for reception of a newspaper, there is a tendancy for such air streams to seek to adversely affect the next succeeding bags in the stack at the same time they are performing their helpful functions with respect to the top bag. For example, some air may find its way into the next-to-the-top bag in the stack. As the newspaper is inserted into the top bag, that air which has entered thenext lower bag will tend to be pushed ahead of the leading end of the newspaper, somewhat in the nature of a bubble. If all bags in the stack extended horizontally for their entire lengths, such entrapped bubble might reach the end of its bag and effectively impede complete entry of the newspaper into its overhead bag. However, because the closed ends of the bags droop over the ends of the trays 68, such trapped bubble simple passes down into the dropped portion of the second bag in the stack to prevent impeding the smooth entry of the newspaper into the top bag.

Furthermore, as discussed earlier, the empty trays 68 of the indexing mechanism 50 have their trailing ends overlapping and resting upon the proximal ends of the next tray in the series. Thus, the empty tray 68 immediately adjacent the stack containing tray at the inserting station 22 rests upon the flaps of the bags in the stack 48 on the tray at station 22. This helps maintain the mouths 112 of the bags below the topmost bag in the stack fully closed to prevent entry of errant portions of the air streams working on the topmost bag.

Having thus disclosed the invention, it will be obvious to those skilled in the art that minor changes in the present invention can be made without departing from the principles of the present invention. Accordingly, the present invention should be limited only by a fair interpretation of the claims which follow.

I claim:

1. Apparatus for bagging newspapers comprising:

means defining an inserting station;

a flat tray;

a stack of superimposed thermo-plastic bags on said tray, each having a newspaper-receiving entry mouth adjacent one end of the bag and a marginal flap projecting outwardly beyond the mouth; means engageable with the flap of the endmost bag in the stack for retaining the bags on the tray, said bags being removable from said tray by tearing the flap of the bag being removed from said retaining means;

means for holding the tray at said inserting station in a manner to present the bags for successively receiving newspapers handled by the apparatus; means at said station for opening the mouth of each successive bag and holding the same in an open condition during the insertion of a newspaper into the bag, said opening means including positive air pressure means directed toward the mouth; means for successively delivering newspapers to said station and inserting the newspapers into respective bags at said station while the bags are held open at the station;

conveyor means leading away from said station for conveying the bagged newspapers in a predetermined direction away from the station;

said flap of each of said bags being foldable into overlying relationship with the bagged newspaper to close the bag;

means along the path of travel of the bagged newspaper downstream from said inserting station engageable with said flap for folding the same into its closed position; and sealing means along the path of travel of the bagged newspaper downstream from said flap folding means in disposition for causing the flap of each bagged newspaper passing said sealing means to heat seal permanently in said closed position, said tray having a flat, upper bag-supporting surface and a projection rising upwardly from said surface and located directly below the mouths of the bags in the supported stack and spaced inwardly from opposite sides of the tray to raise the central portion of the mouths relatively to laterally outboard portions thereof for facilitating opening by said positive air pressure means.

2. Newspaper bagging apparatus as claimed in claim 1, said retaining means including a generally inverted U-shaped wicket having a pair of laterally spaced legs projecting through the stack of bags and the tray and a transverse bight spanning the legs in overlying relationship to the flap of the endmost bag in the stack.

3. Newspaper bagging apparatus as claimed in claim 2, said retaining means further including a pair of spring-loaded hold-down clamps, each including an arm removably overlying said bight and yieldably biased against the latter.

4. Newspaper bagging apparatus as claimed in claim 3, each of said arms having a retaining spike at an outer end thereof penetrating through the flap of the endmost bag and the flaps of the several next adjacent bags in the stack.

5. Newspaper bagging apparatus as claimed in claim 1, said tray having an end remote from said retaining means which is overlaped by the bags to permit the same to drape over said end and facilitate separation of the endmost bag in the stack from the next bag therebelow during preparation of the endmost bag for newspaper reception.

6. Newspaper bagging apparatus as claimed in claim 5, said remote end of the tray having a pair of opposite corners angled obliquely with respect to opposite side and end edges of the tray to promote separation of the endmost bag in a stack from the next bag therebelow.

7. Apparatus for bagging newspapers comprising:

means defining an inserting station;

means for presenting a series of successive thermoplastic bags to said station;

means at said station for holding each successive bag in an open condition during the insertion of a newspaper into the same;

means for successively delivering newspapers to said station and inserting the newspapers into respective bags at said station while the bags are held open at the station;

conveyor means leading away from said station for conveying the bagged newspapers in a predetermined direction away from the station, each of said bags having a closure margin which may be folded into overlying relationship with the bagged newspaper to close the bag;

means along the path of travel of the bagged newspaper downstream from said inserting station engageable with said margin for folding the same into its closed position; and sealing means along the path of travel of the bagged newspaper downstream from said margin folding means in disposition for causing the margin of each bagged newspaper passing said sealing means to heat seal permanently in said closed position, said means for presenting bags to said station including a series of bag-holding modules each provided with a stack of superimposed bags detachably secured to the module, a delivery conveyor to which said modules are secured at spaced intervals, and indexing mechanism operably coupled with said delivery conveyor for successively presenting said modules to said inserting station, said indexing mechanism being operable to periodically index the delivery conveyor through a predetermined amount of travel sufficient to shift a module having a depleted supply of bags away from the inserting station and to bring the next successive module having a full supply of bags into position at said inserting station.

8. Newspaper bagging apparatus as claimed in claim 7, each of said modules being provided with means detachably coupling the same with said delivery conveyor to facilitate removal of depleted modules from the conveyor and refilling with a new supply of bags.

9. Newspaper bagging apparatus as claimed in claim 7, said means for delivering newspapers to said station being operable to deliver the newspapers in a substantially horizontal path of travel, said bag presenting means being disposed below said path of travel of the newspapers and said delivery conveyor of the bag presenting means having an upper horizontal run which is operable to present the bags in a substantially horizontal condition at said inserting station.

10. Newspaper bagging apparatus as claimed in claim 9, each of said modules including a backing tray for the stack of bags thereon, said tray being hingedly coupled with said delivery conveyor of the bag presenting means to permit the trays to suspend from the conveyor in generally upright conditions along a lower run of the delivery conveyor and to swing up to generally horizontal positions along the upper run of the delivery conveyor, said delivery conveyor further including means for swinging the trays into said horizontal positions thereof along the upper run of the delivery conveyor and temporarily retaining the same in such horizontal positions.

11. Newspaper bagging apparatus as claimed in claim 10, each of said modules including a wicket passing through a projecting flap of each bag on the module to detachably secure the bag to the module, said bags being operable to tear free from their wicket upon the insertion of a newspaper into the same and movement of the package in the downstream direction away from the inserting station.

12. Apparatus for bagging newspapers comprising:

means defining an inserting station;

means for presenting a series of successive thermoplastic bags to said station;

means at said station for holding each successive bag in an open condition during the insertion of a newspaper into the same;

means for successively delivering newspapers to said station and inserting the newspapers into respective bags at said station while the bags are held open at the station;

conveyor means leading away from said station for conveying the bagged newspapers in a predetermined direction away from the station, each of said bags having a closure margin which may be folded into overlying relationship with the bagged newspaper to close the bag;

means along the path of travel of the bagged newspaper downstream from said inserting station engageable with said margin for folding the same into its closed position; and sealing means along the path of travel of the bagged newspaper paper downstream from said margin folding means in disposition for causing the margin of each bagged newspaper pasing said sealing means to heat seal permanently in said closed position, said bag presenting means including means for disposing each successive bag in a generally flat condition at said inserting station, said means for holding each bag in an open condition including air jet means directed toward the mouth of each successive bag at the inserting station for holding the mouth open by positive air pressure and a pair of retainers insertable into the mouth of the bag upon opening thereof by the positive air pressure and engageable with opposite lateral extremities of the bag to hold the mouth open for the next incoming newspaper, said retainers being mounted for pivoting movement between standby positions projecting in opposite directions across the path of travel of the incoming newspaper slightly outside of the mouth of the next successive bag at the inserting station and retaining positions projecting into the mouth in the longitudinal direction with respect of the path of travel of the incoming newspaper, said retainers having mechanism operably coupled therewith for pivoting the same from their standby positions to their retaining positions just prior to the entry of the next succeeding newspaper into the open mouth of the awaiting bag at the inserting station, for keeping the retainers in said retaining positions until the bagged newspaper package has left the inserting station, and for returning the retainers to their standby positions from their retaining positions following departure of the bagged newspaper package from the inserting station, said means for deliverying newspapers to said station and inserting the same into respective bags including a reception table upstream from said inserting station and upon which newspapers to be inserted are received seriatim, and a series of inserters moveable along said reception table toward said inserting station and at predetermined intervals for engaging respective newspapers received on said table and propelling the same into respective awaiting bags at the inserting station, said inserters having periodically operable clamping nip rollers cooperable therewith to propel each bagged newspaper package away from the inserting station and onto said conveyor means following each insertion of a newspaper into its respective bag, said bag presenting means including structure holding a supply of the bags in superimposed relationship at said inserting station, each of said bags being operable to tear free from said structure following insertion of a newspaper into the same and under the propelling force of said inserter and the nip rollers as they urge the bagged newspaper package onto said conveying means.

13. Apparatus for bagging newspapers comprising:

means defining an inserting station;

means for presenting a series of successive thermoplastic bags to said station;

means at said station for holding each successive bag in an open condition during the insertion of a newspaper into the same;

means for successively delivering newspapers to said station and inserting the newspapers into respective bags at said station while the bags are held open at the station;

conveyor means leading away from said station for conveying the bagged newspapers in a predetermined direction away from the station, each of said bags having a closure margin which may be folded into overlying relationship with the bagged newspaper to close the bag;

means along the path of travel of the bagged newspaper downstream from said inserting station engageable with said margin for folding the same into its closed position; and sealing means along the path of travel of the bagged newspaper downstream from said margin folding means in disposition for causing the margin of each bagged newspaper passing said sealing means to heat seal permanently in said closed position, said means for delivering newspapers to said station and inserting the same into respective bags including a reception table upstream from said inserting station and upon which newspapers to be inserted are received seriatim, and a series of inserters moveable along said reception table toward said inserting station and at predetermined intervals for engaging respective newspapers received on said table and propelling the same into respective awaiting bags at the inserting station, said reception table including means for bending the newspaper in such a direction and to such an extent as to form a stiffening ridge therein extending parallel to the direction of movement of the newspaper into the awaiting bag, said ridge forming means being operable to form the ridge in the newspaper prior to engagement of the newspaper by the inserter.

14. Apparatus for bagging newspapers comprising:

means defining an inserting station;

means for presenting a series of successive thermoplastic bags to said station;

means at said station for holding each successive bag in an open condition during the insertion of a newspaper into the same;

means for successively delivering newspapers to said station and inserting the newspapers into respective bags at said station while the bags are held open at the station;

conveyor means leading away from said station for conveying the bagged newspapers in a predetermined direction away from the station, each of said bags having a closure margin which may be folded into overlying relationship with the bagged newspaper to close the bag;

means along the path of travel of the bagged newspaper downstream from said inserting station engageable with said margin for folding the same into its closed position; and sealing means along the path of travel of the bagged newspaper downstream from said margin folding means in disposition for causing the margin of each bagged newspaper passing said sealing means to heat seal permanently in said closed position, said means for deliverying newspapers to said station and inserting the same into respective bags including a reception table upstream from said inserting station and upon which newspapers to be inserted are received seriatim, and a series of inserters moveable along said reception table toward said inserting station and at predetermined intervals for engaging respective newspapers receive on said table and propelling the same into respective awaiting bags at the inserting station, said inserters having periodically operating, clamping nip rollers cooperable therewith to propel each bagged newspaper package away from the inserting station and onto said conveyor means following each insertion of a newspaper into its respective bag, said bag presenting means including structure holding a supply of the bgs in superimposed relationship at said inserting station, each of said bags being operable to tear free from said structure following insertion of a newspaper into the same and under the propelling force of said inserter and the nip rollers as they urge the bagged newspaper package onto said conveyor means.

15. Newspaper bagging apparatus as claimed in claim 14, said means for holding each bag in an open condition including air jet means directed toward an entry mouth of the bag, said bags being initially maintained in a position in which remote ends thereof are draped downwardly prior to opening of the entry mouth, the remote end of the next bag to be inserted rising up into a horizontal condition upon entry of air streams from said jet means into the bag, said remote end of the next bag engaged by a lower roller of said clamping nip rollers upon entry of the air streams into the bag whereby to assist in maintaining the bag in a horizontal condition during insertion of a newspaper.

16. Apparatus for bagging newspapers comprising:

means defining an inserting station;

means for presenting a series of successive thermoplastic bags to said station;

means at said station for holding each successive bag in an open condition during the insertion of a newspaper into the same;

means for successively delivering newspapers to said station and inserting the newspapers into respective bags at said station while the bags are held open at the station;

conveyor means leading away from said station for conveying the bagged newspapers in a predetermined direction away from the station, each of said bags having a closure margin which may be folded into overlying relationship with the bagged newspaper to close the bag;

means along the path of travel of the bagged newspaper downstream from said inserting station engageable with said margin for folding the same into its closed position; and sealing means along the path of travel of the bagged newspaper downstream from said margin folding means in disposition for causing the margin of each bagged newspaper passing said sealing means to heat seal permanently in said closed position, said bagged newspaper package being disposed when at said inserting station with the mouth of the bag extending transverse to the path of travel of the package, said conveyor means including means upstream from the sealing means for reorienting the bagged newspaper package in such a manner that the mouth of the bag extends in a direction parallel to the path of travel of the package as the package is exposed to said sealing means.

17. Newspaper bagging apparatus as claimed in claim 16, said sealing means including an elongated heating element in spaced, superimposed relationship with said conveying means and extending parallel to the path of travel of the bagged newspaper package and an endless heat transfer element driven in such a direction and at such a speed as to present a package-engaging run thereof in position to engage successive bagged newspaper packages as the latter move past the sealing means and to thermally fuse the folded over margin of the bag against other contiguous portions thereof.

18. Newspaper bagging apparatus as claimed in claim 17, said heat transfer element being so disposed relative to each bagged newspaper package moving therepast that a portion of the newspaper of the package being sealed is disposed directly beneath the transfer element during sealing to function as a heat sink.

19. In a method of bagging newspapers, the improved steps of:

presenting a stack of superimposed, thermoplastic bags to an inserting station;

opening a mouth of the endmost bag of the stack and holding the endmost bag in an open condition while it remains on the stack;

inserting a newspaper into the open bag at the inserting station to present a bagged newspaper package;

shifting the package away from said inserting station whereby to simultaneously remove the endmost bag from the stack at the station; and heat sealing the mouth of the bag of the package in a closed condition whereby to protectively enclose the newspaper within the bag, said inserting step including bending the newspaper in a direction and in an amount sufficient to form a stiffening ridge in the newspaper extending parallel to the direction of the inserting movement of the newspaper into the opened endmost bag, said inserting step further including pushing the ridged newspaper at least partially into the opened endmost bag while maintaining said ridge therein, said step of bending the newspaper to form a stiffening ridge being carried out prior to commencing the pushing step.

20. In a method of bagging newspapers as claimed in claim 19; and prior to said heat sealing step, folding a marginal portion of the bag into overlapping engagement with a top wall of the bag and the newspaper contained therein, said heat sealing step including the step of thermally fusing said folded marginal portion of the bag to the top wall thereof and using the newspaper as a heat sink during such thermal fusing.

21. In a method of bagging newspapers as claimed in claim 20, said folding and heat sealing steps being carried out while the newspaper package is moving along a predetermined path of travel.

22. In a method of bagging newspapers as claimed in claim 19, said step of presenting bags to the inserting station including holding the bags of the stack in place with a retaining wicket passing through superimposed, marginal portions of the bags, said step of shifting the package away from the station and removing the endmost bag from the stack including the step of tearing the endmost bag off said retaining wicket.

* * * * *